US012429221B2

(12) United States Patent
Naik et al.

(10) Patent No.: US 12,429,221 B2
(45) Date of Patent: Sep. 30, 2025

(54) ANNULAR COMBUSTOR DILUTION WITH SWIRL VANES FOR LOWER EMISSIONS

(71) Applicant: General Electric Company, Schenectady, NY (US)

(72) Inventors: Pradeep Naik, Bengaluru (IN); Shai Birmaher, Cincinnati, OH (US); Saket Singh, Bengaluru (IN); Rimple Rangrej, Bengaluru (IN); Krishnendu Chakraborty, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 579 days.

(21) Appl. No.: 17/649,218

(22) Filed: Jan. 28, 2022

(65) Prior Publication Data

US 2023/0094199 A1 Mar. 30, 2023

(30) Foreign Application Priority Data

Sep. 30, 2021 (IN) ..... 202111044412

(51) Int. Cl.

| | |
|---|---|
| ***F23R 3/26*** | (2006.01) |
| ***F23R 3/00*** | (2006.01) |
| ***F23R 3/04*** | (2006.01) |
| ***F23R 3/06*** | (2006.01) |
| ***F23R 3/14*** | (2006.01) |
| ***F23R 3/16*** | (2006.01) |
| ***F23R 3/50*** | (2006.01) |
| ***F23R 3/60*** | (2006.01) |

(52) U.S. Cl.

CPC ..... *F23R 3/26* (2013.01); *F23R 3/002* (2013.01); *F23R 3/04* (2013.01); *F23R 3/045* (2013.01); *F23R 3/06* (2013.01); *F23R 3/14* (2013.01); *F23R 3/16* (2013.01); *F23R 3/50* (2013.01); *F23R 3/60* (2013.01)

(58) Field of Classification Search

CPC .... F23R 3/04; F23R 3/045; F23R 3/06; F23R 3/26; F23R 3/14; F23R 3/16; F23R 3/60; F23R 3/50

See application file for complete search history.

(56) References Cited

U.S. PATENT DOCUMENTS

| | | | |
|---|---|---|---|
| 4,301,657 | A | 11/1981 | Penny |
| 4,875,339 | A | 10/1989 | Rasmussen et al. |
| 7,891,194 | B2 | 2/2011 | Biebel et al. |
| 8,176,739 | B2 | 5/2012 | Evulet et al. |
| 9,038,395 | B2 | 5/2015 | Rudrapatna et al. |

(Continued)

FOREIGN PATENT DOCUMENTS

| | | | |
|---|---|---|---|
| CN | 101016997 | A | 8/2007 |
| CN | 103459928 | A | 12/2013 |
| JP | H085076 | A | 1/1996 |

*Primary Examiner* — Jason H Duger

(74) *Attorney, Agent, or Firm* — Venable LLP; Duarte Y Ho; Michele V. Frank

(57) ABSTRACT

A combustor liner for a combustor of a gas turbine includes an outer liner and an inner liner. The outer liner has an annular outer liner slot dilution opening, with a plurality of outer liner swirl vanes disposed within the annular outer liner slot dilution opening. The inner liner of the combustor liner includes an annular inner liner slot dilution opening, and also includes a plurality of inner liner swirl vanes disposed within the annular inner liner slot dilution opening.

20 Claims, 15 Drawing Sheets

(56) References Cited

U.S. PATENT DOCUMENTS

| | | | | |
|---|---|---|---|---|
| 9,328,665 | B2 | 5/2016 | Doerr et al. | |
| 9,976,743 | B2 * | 5/2018 | Propheter-Hinckley | F23R 3/14 |
| 10,012,386 | B2 * | 7/2018 | Prade | F23R 3/14 |
| 10,684,017 | B2 | 6/2020 | Moura et al. | |
| 10,787,927 | B2 | 9/2020 | Krewinkel | |
| 11,236,906 | B2 * | 2/2022 | Snyder | F23R 3/005 |
| 2002/0189260 | A1 | 12/2002 | David et al. | |
| 2010/0242483 | A1 * | 9/2010 | Snyder | F23R 3/06 60/757 |
| 2013/0298564 | A1 | 11/2013 | Agarwal | |
| 2015/0354819 | A1 | 12/2015 | Snyder et al. | |

* cited by examiner

ANNULAR COMBUSTOR DILUTION WITH SWIRL VANES FOR LOWER EMISSIONS

CROSS REFERENCE TO RELATED APPLICATIONS

The present application claims the benefit of Indian Patent Application No. 202111044412, filed on Sep. 30, 2021, which is hereby incorporated by reference herein in its entirety.

TECHNICAL FIELD

The present disclosure relates to a dilution of combustion gases in a combustion chamber of a gas turbine engine.

BACKGROUND

In conventional gas turbine engines, it has been known to provide a flow of dilution air into a combustion chamber downstream of a primary combustion zone. Conventionally, an annular combustor liner may include both an inner liner and an outer liner forming a combustion chamber between them. The inner liner and the outer liner may include dilution holes through the liners that provide a flow of air (i.e., a dilution jet) from a passage surrounding the annular combustor liner into the combustion chamber. Some applications have been known to use circular holes for providing dilution air flow to the combustion chamber. The flow of air through the circular dilution holes in the conventional combustor mixes with combustion gases within the combustion chamber to provide quenching of the combustion gases. High temperature regions seen behind the dilution jet (i.e., in the wake region of dilution jet) are associated with high NOx formation. In addition, the circular dilution air jet does not spread laterally, thereby creating high temperatures in-between dilution jets that also contribute to high NOx formation.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Various embodiments are discussed in detail below. While specific embodiments are discussed, this is done for illustration purposes only. A person skilled in the relevant art will recognize that other components and configurations may be used without departing from the spirit and scope of the present disclosure.

In a combustion section of a turbine engine, air flows through an outer passage surrounding a combustor liner. The air generally flows from an upstream end of the combustor liner to a downstream end of the combustor liner. Some of the airflow in the outer passage is diverted through dilution holes in the combustor liner and into the combustion chamber as dilution air. One purpose of the dilution airflow is to cool (i.e., quench) combustion gases within the combustion chamber before the gases enter a turbine section. However, quenching of the product of combustion from the primary zone must be done quickly and efficiently so that regions of high temperature can be minimized, and thereby NOx emissions from the combustion system can be reduced.

The present disclosure aims to reduce the NOx emissions by improving the dilution quenching of the hot combustion gases from the primary combustion zone. According to the present disclosure, a combustor liner includes an outer liner having an annular outer liner slot dilution opening in an outer liner, with a plurality of outer liner swirl vanes disposed within the annular outer liner slot dilution opening. Similarly, an inner liner of the combustor liner includes an annular inner liner slot dilution opening, and also includes a plurality of inner liner swirl vanes disposed within the annular inner liner slot dilution opening. Thus, the annular slot can generally provide an even distribution of air from the surrounding flow passages into the combustion chamber, and the swirl vanes can impart a swirled flow into the air passing through the slot dilution opening. Accordingly, a better distribution of the dilution air into the combustion chamber can be obtained, and better mixing of the dilution air with combustion gases can be obtained via turbulence provided by the swirled air flow.

Figure 1:
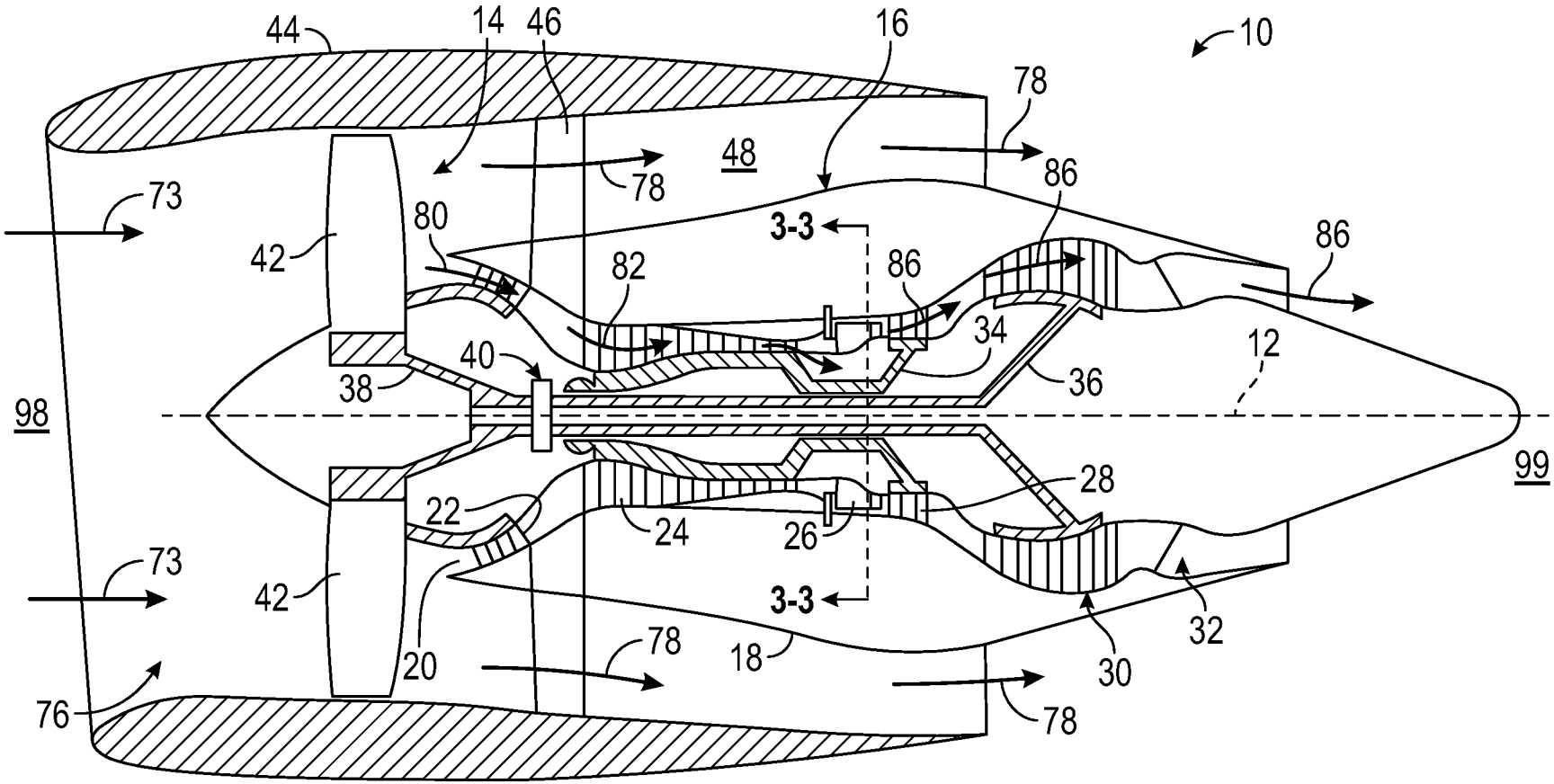
FIG. 1 is a schematic partially cross-sectional side view of an exemplary high by-pass turbofan jet engine, according to an embodiment of the present disclosure.

Referring now to the drawings, FIG. 1 is a schematic partially cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22 and a high pressure (HP) compressor 24, a combustion section 26, a turbine section, including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive configuration or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to, and that extend radially outwardly from, the fan shaft 38. An annular fan casing, or nacelle 44, circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16, so as to define a bypass airflow passage 48 therebetween.

Figure 2:
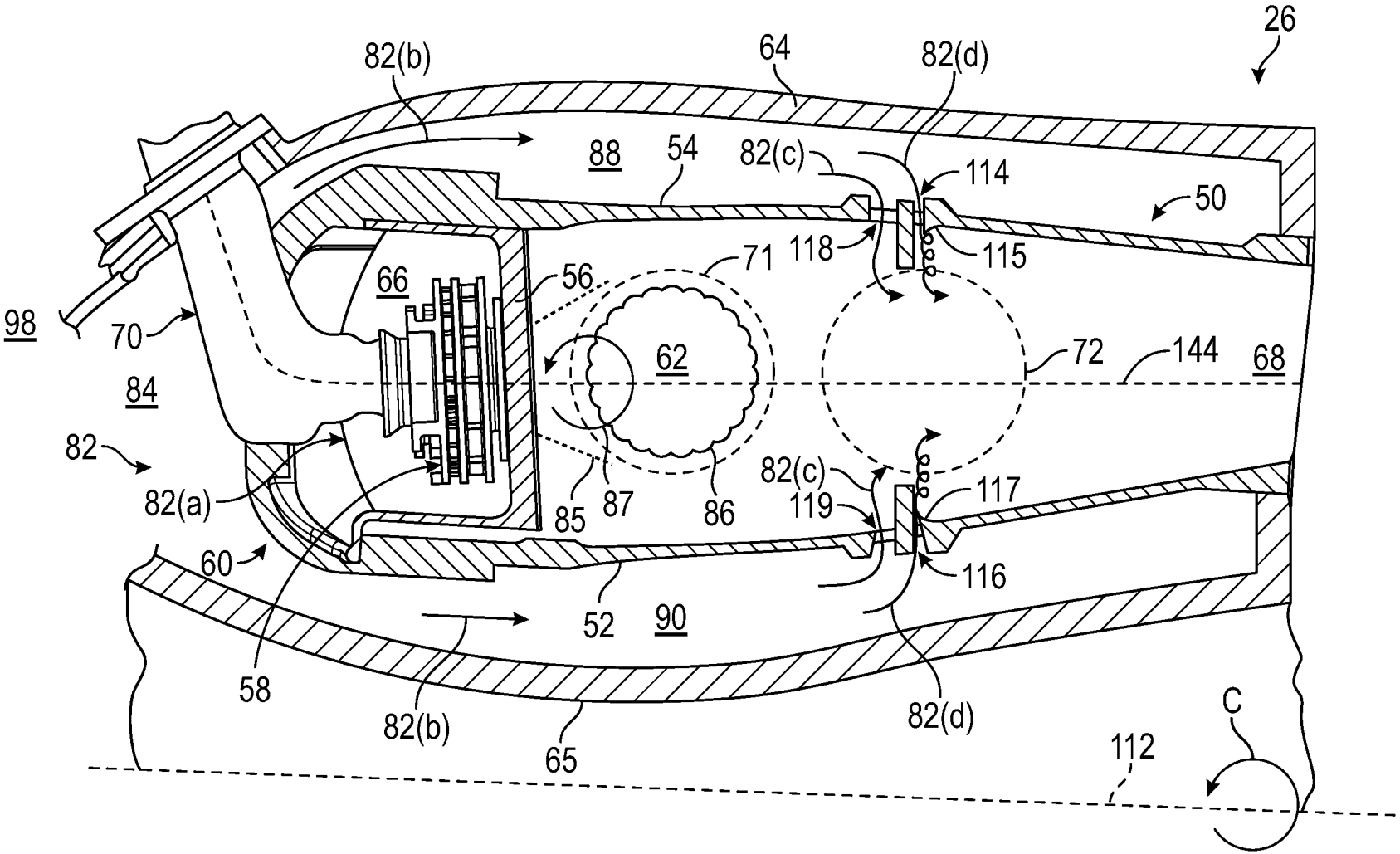
FIG. 2 is a cross-sectional side view of an exemplary combustion section, according to an embodiment of the present disclosure.

FIG. 2 is a cross-sectional side view of an exemplary combustion section 26 of the core engine 16 as shown in FIG. 1. As shown in FIG. 2, the combustion section 26 may generally include a cowl 60 that is connected to a combustor liner 50 and a dome assembly 56. The combustor liner 50 includes an inner liner 52 and an outer liner 54. The inner liner 52, the outer liner 54, and the dome assembly 56 together define a combustion chamber 62. The combustion chamber 62 may more specifically define various regions, including a primary combustion zone 71 at which initial chemical reaction of a fuel-oxidizer mixture and/or recirculation of combustion gases 86 may occur before flowing further downstream to a dilution zone 72, where mixture and/or recirculation of the combustion gases 86 and compressed air 82(*c*) and compressed air 82(*d*) may occur before flowing into HP turbine 28 and LP turbine 30 (FIG. 1) via a turbine inlet 68. The dome assembly 56 extends radially between the outer liner 54 and the inner liner 52, and includes a swirler assembly 58 connected thereto.

As shown in FIG. 2, the inner liner 52 may be encased within an inner casing 65 and the outer liner 54 may be encased within an outer casing 64. An outer flow passage 88 is defined between the outer casing 64 and the outer liner 54, and an inner flow passage 90 is defined between the inner casing 65 and the inner liner 52. As will be described in more detail below, the outer liner 54 is seen to include an annular outer liner slot dilution opening 114 that has a plurality of outer liner swirl vanes 115 disposed therein, and may optionally include a second annular outer liner slot dilution opening 118. Similarly, the inner liner 52 includes an annular inner liner slot dilution opening 116 having a plurality of inner liner swirl vanes 117 disposed therein, and may optionally include a second annular inner liner slot dilution opening 119. The annular outer liner slot dilution opening 114 extends through the outer liner 54 circumferentially about a combustor centerline 112, and the annular inner liner slot dilution opening extends through the inner liner 52 circumferentially about the combustor centerline 112. The annular outer liner slot dilution opening 114 having the plurality of outer liner swirl vanes 115 disposed therein provides a flow of compressed air 82(*d*) therethrough, where a swirl is induced into the flow as the compressed air 82(*d*) flows into the dilution zone 72 of the combustion chamber 62. The optional second annular outer liner slot dilution opening 118 may provide for a flow of compressed air 82(*c*) to flow therethrough in the radial direction into the dilution zone 72 of the combustion chamber 62. The flow of compressed air 82(*c*) and the flow of compressed air 82(*d*) can thus be utilized to provide quenching of the combustion gases 86 in the dilution zone 72 so as to cool the flow of combustion gases 86 entering the turbine section. A similar flow of the compressed air 82(*c*) is provided through the second annular inner liner slot dilution opening 119, and of the compressed air 82(*d*) through the annular inner liner slot dilution opening 116 having the plurality of inner liner swirl vanes 117 therein.

During operation of the engine 10, as shown in FIGS. 1 and 2 collectively, a volume of air 73, as indicated schematically by arrows, enters the engine 10 from upstream end 98 through an associated inlet 76 of the nacelle 44 and/or fan assembly 14. As the volume of air 73 passes across the fan blades 42, a portion of the air 73, as indicated schematically by arrows 78, is directed or routed into the bypass airflow passage 48, while another portion of air 80, as indicated schematically by an arrow, is directed or routed into the LP compressor 22. Air 80 is progressively compressed as it flows through the LP compressor 22 and the HP compressor 24 towards the combustion section 26. Referring to FIG. 2, the now compressed air 82, as indicated schematically by an arrow, flows into a diffuser cavity 84 of the combustion section 26 and pressurizes the diffuser cavity 84. A first portion of the compressed air 82, as indicated schematically by arrows 82(*a*), flows from the diffuser cavity 84 into a pressure plenum 66, where it is then swirled and mixed with fuel provided by fuel nozzle assembly 70, by swirler assembly 58 to generate a swirled fuel-air mixture 85 that is injected into the combustion chamber 62 in a swirl direction 87 that is either in a clockwise swirl direction or in a counterclockwise swirl direction about a swirler assembly centerline axis 144, and is then ignited and burned to generate the combustion gases 86. Typically, the LP compressor 22 and the HP compressors 24 (FIG. 1) provide more compressed air to the diffuser cavity 84 than is needed for combustion. Therefore, a second portion of the compressed air 82(*b*), as indicated schematically by arrows, may be used for various purposes other than combustion. For example, as shown in FIG. 2, compressed air 82(*b*) may be routed into the outer flow passage 88 and into the inner flow passage 90. A portion of the compressed air 82(*b*) may then be routed through the annular outer liner slot dilution opening 114 (schematically shown as compressed air 82(*d*)) and into the dilution zone 72 of combustion chamber 62 to provide quenching of the combustion gases 86 in dilution zone 72. The compressed air 82(*d*) may also provide turbulence to the flow of combustion gases 86 so as to provide better mixing of the compressed air 82(*d*) with the combustion gases 86. In addition, when the second annular outer liner slot dilution opening 118 is included in the outer liner 54, a portion of the compressed air 82(*b*) (schematically shown as compressed air 82(*c*)) may be routed through the second annular outer liner slot dilution opening 118 into the dilution zone 72 of the combustion chamber 62. A similar flow of the compressed air 82(*d*) from the inner flow passage 90 through the annular inner liner slot dilution opening 116, where it is swirled by the plurality of inner liner swirl vanes 117, and provided to the dilution zone 72 of the combustion chamber 62. In addition, when the second annular inner liner slot dilution opening 119 is provided, the compressed air 82(*c*) may be routed therethrough into the dilution zone 72 of the combustion chamber 62.

Referring back to FIGS. 1 and 2 collectively, the combustion gases 86 generated in the combustion chamber 62 flow from the combustion section 26 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at downstream end 99.

Figure 3:
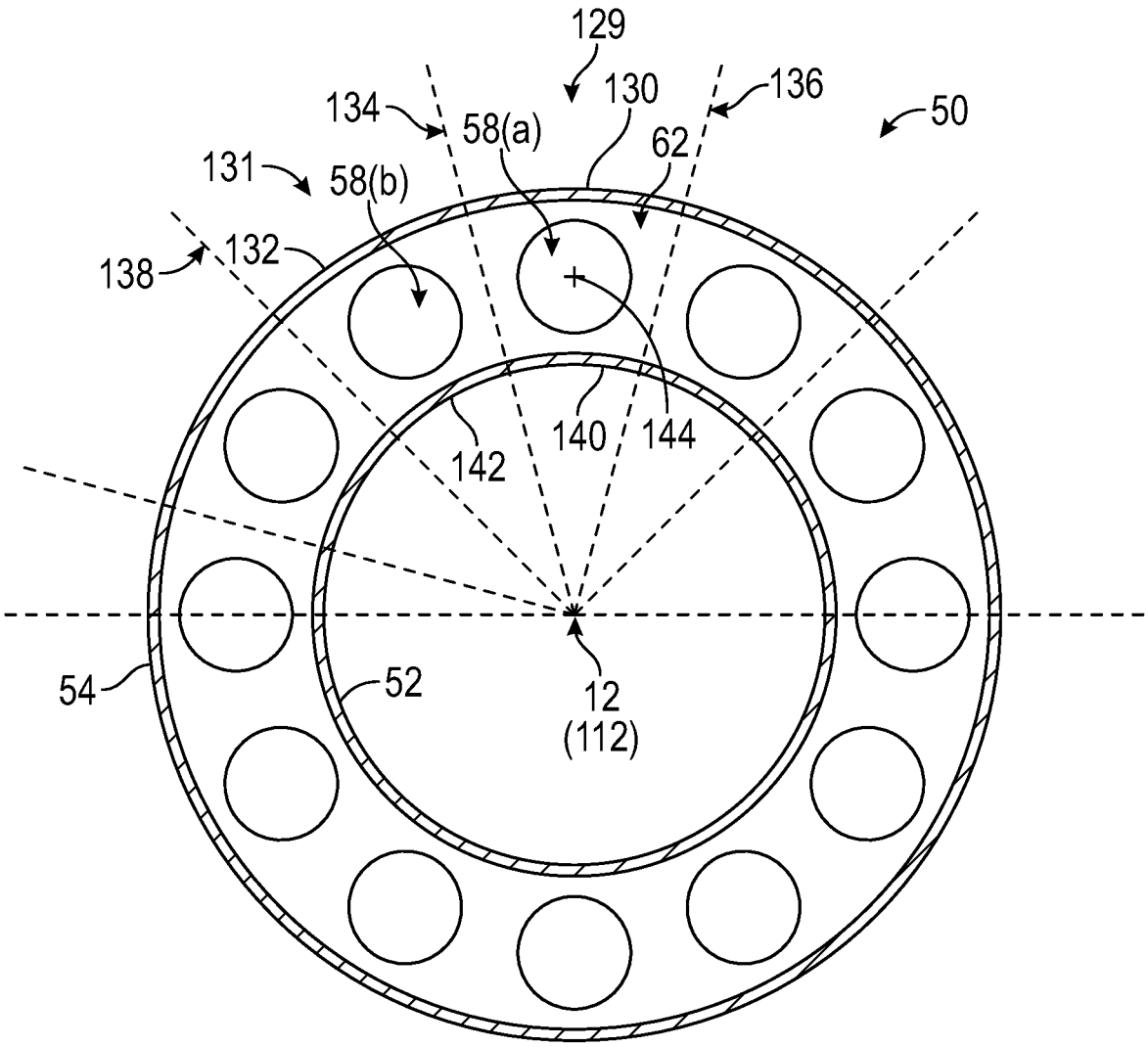
FIG. 3 depicts a partial cross-sectional view of a combustor liner, taken at plane 3-3 of FIG. 1, according to an embodiment of the present disclosure.

FIG. 3 is a partial cross-sectional view of the combustor liner 50 taken at plane 3-3 shown in FIG. 1. As seen in FIG. 3, the combustor liner 50 is a generally annular liner that extends circumferentially about the centerline axis 12 of the engine 10. As it may relate to the combustor liner 50, the centerline axis 12 may also correspond to a combustor centerline 112. The combustor liner 50 includes the outer liner 54 and the inner liner 52. Representative swirler assemblies 58(*a*) and 58(*b*) are shown as being circumferentially spaced about the combustor centerline 112. With respect to each swirler assembly 58(*a*) and 58(*b*), a portion of the combustor liner 50 may be considered as a segment of the combustor liner 50. That is, the combustor liner 50, although it may be a one piece liner extending circumferentially the combustor centerline 112, it may be considered to include multiple segments (e.g., a first segment 129, a second segment 131, etc.) circumferentially about the combustor centerline 112, where each segment corresponds to a respective swirler assembly 58. For example, the first segment 129 may correspond to a first segment swirler assembly 58(*a*), and may be defined between a segment boundary line 134 and a segment boundary line 136, which extend radially outward from combustor centerline 112 and may be equally angularly spaced apart from the segment swirler assembly centerline axis 144 (see also, FIG. 2) of the first segment swirler assembly 58(*a*). Similarly, the second segment 131 may be associated with a second segment swirler assembly 58(*b*), and may be defined between segment boundary line 134 and a segment boundary line 138. The second segment 131 is adjacent to the first segment 129. The first segment 129 includes a first segment outer liner 130 and a first segment inner liner 140, while the second segment 131 includes a second segment outer liner 132 and a second segment inner liner 142.

Figure 4:
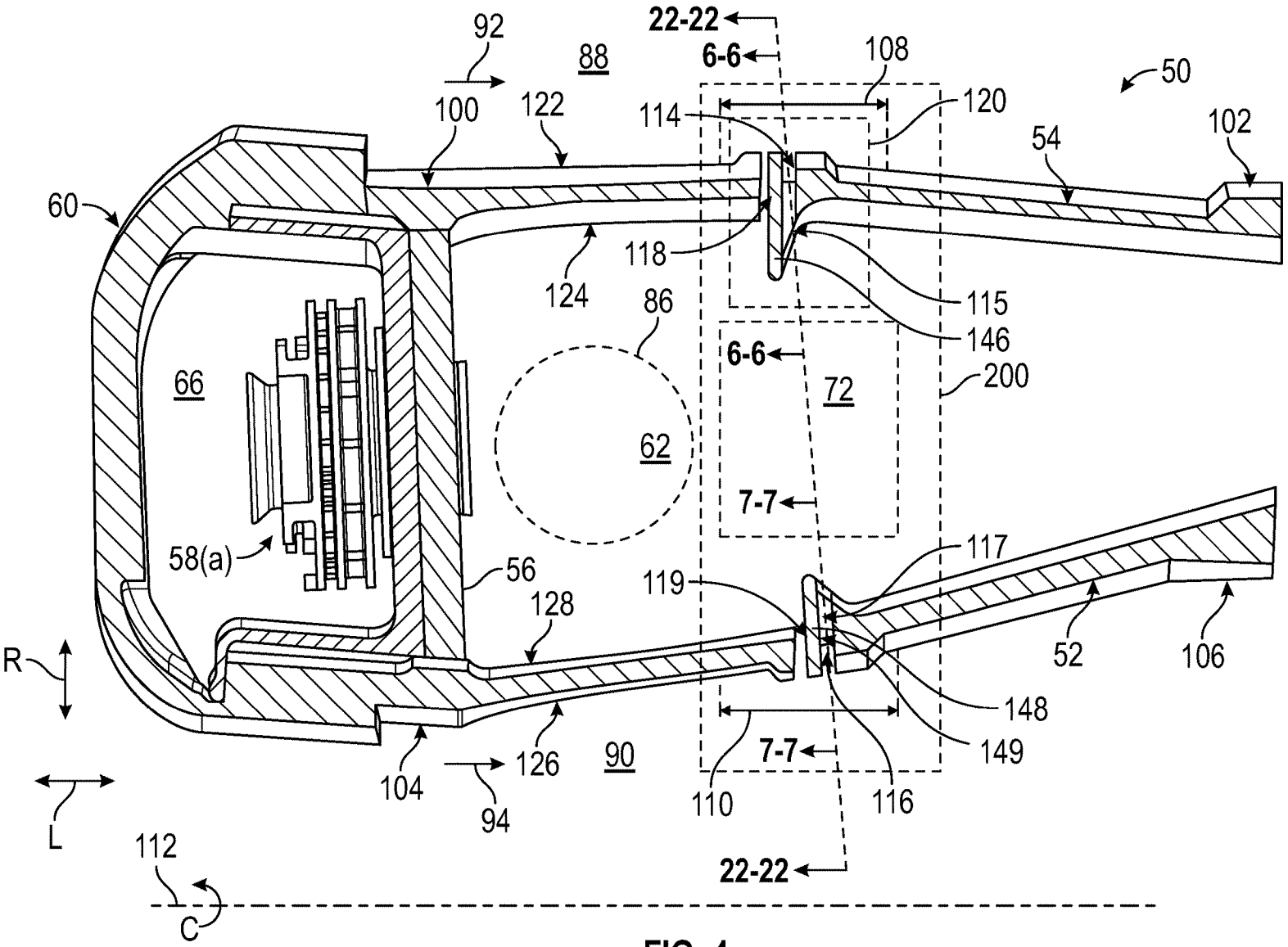
FIG. 4 depicts a partial cross-sectional side view of an exemplary combustor liner, according to an aspect of the present disclosure.

FIG. 4 depicts a partial cross-sectional view of the combustor liner 50, according to an aspect of the present disclosure. In FIG. 4, the first segment swirler assembly 58(*a*) is depicted merely for reference purposes. As seen in FIG. 4, the combustor liner 50 defines an axial direction (L), which may be parallel to the combustor centerline 112, a radial direction (R), which extends generally perpendicular to the combustor centerline 112, and a circumferential direction (C) about the combustor centerline 112. The outer liner 54 extends circumferentially about the combustor centerline 112, and extends in the axial direction from an outer liner upstream end 100 to an outer liner downstream end 102. An outer liner dilution zone 108 is defined between the outer liner upstream end 100 and the outer liner downstream end 102. The outer liner 54 has an outer liner cold surface side 122 adjacent to the outer flow passage 88, and an outer liner hot surface side 124 adjacent to the combustion chamber 62. As was illustrated and described in FIG. 2, a portion of the compressed air 82(*b*) flows in the outer flow passage 88, and the compressed air 82(*b*) flows from the outer liner upstream end 100 toward the outer liner downstream end 102, thereby defining an outer flow direction 92 that extends in the axial direction (L). The outer liner 54 further includes the annular outer liner slot dilution opening 114, which has the plurality of outer liner swirl vanes 115 disposed therein, and optionally, may include the second annular outer liner slot dilution opening 118. The annular outer liner slot dilution opening 114 and the optional second annular outer liner slot dilution opening 118 generally extend through the outer liner 54 circumferentially about the combustor centerline 112. As will be described in more detail below, the outer liner 54 may also include an annular outer liner radial wall 146 that extends at least partially in the radial direction into the combustion chamber 62 from the outer liner hot surface side 124, where the plurality of outer liner swirl vanes 115 may be disposed on the annular outer liner radial wall 146. Various arrangements of the annular outer liner slot dilution opening 114 and the plurality of outer liner swirl vanes 115 will be described in more detail below.

The combustor liner 50 of FIG. 4 also includes the inner liner 52 that extends circumferentially about the combustor centerline 112, and extends from an inner liner upstream end 104 to an inner liner downstream end 106, An inner liner dilution zone 110 is defined between the inner liner upstream end 104 and the inner liner downstream end 106. The inner liner 52 has an inner liner cold surface side 126 adjacent to the inner flow passage 90, and an inner liner hot surface side 128 adjacent to the combustion chamber 62. As was illustrated and described in FIG. 2, a portion of the compressed air 82(*b*) flows in the inner flow passage 90, and the compressed air 82(*b*) flows from the inner liner upstream end 104 toward the inner liner downstream end 106, thereby defining an inner liner flow direction 94 that extends in the axial direction (L). The inner liner 52 further includes an annular inner liner slot dilution opening 116, having the plurality of inner liner swirl vanes 117 therein, and, optionally, may include the second annular inner liner slot dilution opening 119. As will be described in more detail below, the inner liner 52 may also include an annular inner liner radial wall 148 disposed on an upstream side 149 of the annular inner liner slot dilution opening 116, and that extends at least partially in the radial direction into the combustion chamber 62 from the inner liner hot surface side 128, where the plurality of inner liner swirl vanes 117 may be disposed on the annular inner liner radial wall 148.

Figure 5:
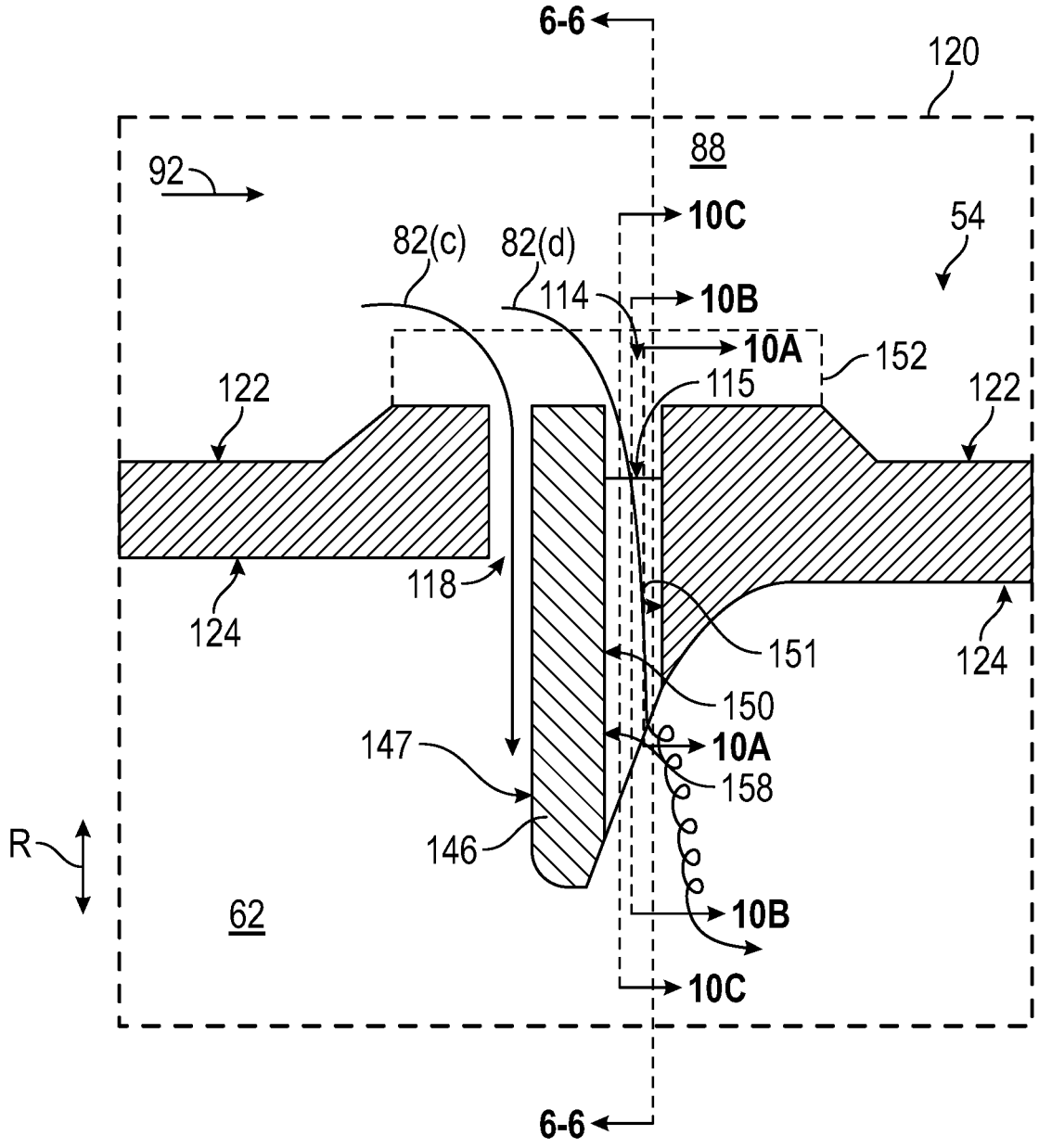
FIG. 5 is a detail view taken a detail 120 of FIG. 4, and depicts an exemplary annular outer liner slot dilution opening/outer liner swirl vane arrangement, according to an aspect of the present disclosure.

FIG. 5 is a detail view taken at detail 120 of FIG. 4, and depicts an exemplary annular outer liner slot dilution opening/outer liner swirl vane arrangement, according to an aspect of the present disclosure. In FIG. 5, as with FIG. 4, the outer liner 54 includes the annular outer liner slot dilution opening 114 therethrough, and the plurality of outer liner swirl vanes 115 are disposed within the annular outer liner slot dilution opening 114. In the aspect of FIG. 5, an annular outer liner radial wall 146 is seen to be disposed on an upstream side 150 of the annular outer liner slot dilution opening 114. The annular outer liner radial wall 146 extends circumferentially about the combustor centerline 112, and extends from the outer liner 54 at least partially in the radial direction (R) into the combustion chamber 62. With the inclusion of the annular outer liner radial wall 146, the plurality of outer liner swirl vanes 115 may be disposed on a downstream side 158 of the annular outer liner radial wall 146.

In the FIG. 5 aspect, the outer liner 54 also includes the second annular outer liner slot dilution opening 118 disposed on an upstream side 147 of the annular outer liner radial wall 146, and that extends circumferentially about the combustor centerline 112 through the outer liner 54. When the second annular outer liner slot dilution opening 118 is implemented, a plurality of bridge members 152 may also be included so as to bridge the gap in the outer liner 54. The plurality of bridge members 152 may be spaced circumferentially about the outer liner 54 and may be brazed or welded to the outer liner 54. The second annular outer liner slot dilution opening 118 shown in FIG. 5 does not include swirl vanes, but as will be described below with various additional aspects, swirl vanes may be included in the second annular outer liner slot dilution opening 118. When swirl vanes are not included in the second annular outer liner slot dilution opening 118, the flow of compressed air 82(*c*) therethrough is generally a radially directed flow into the dilution zone 72 (FIG. 4) of the combustion chamber 62.

Figure 6:
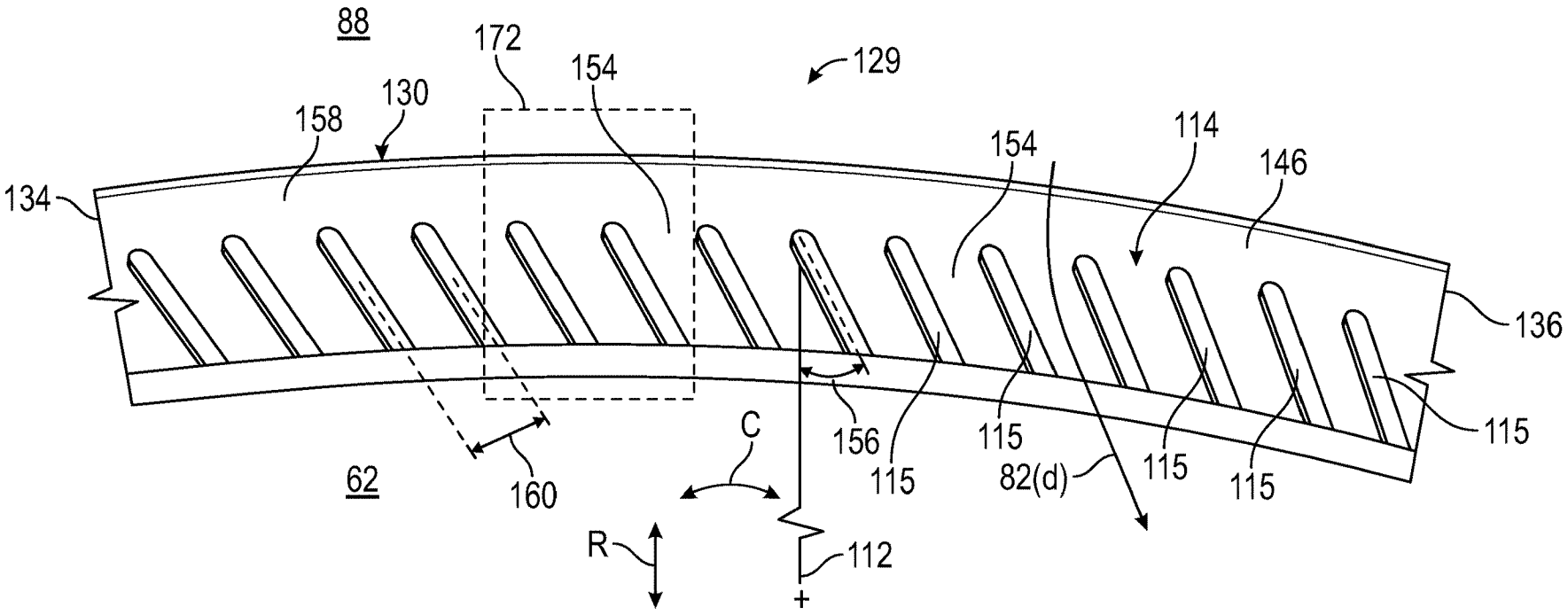
FIG. 6 is a partial cross-sectional view through the annular outer liner slot dilution opening 114 taken at plane 6-6 of FIG. 4, according to an aspect of the present disclosure.

FIG. 6 is a partial cross-sectional view through the annular outer liner slot dilution opening 114 taken at plane 6-6 of FIG. 4 (see also FIG. 5). In FIG. 6, the cross section may correspond to the first segment outer liner 130 of the first segment 129 (FIG. 3) between segment boundary line 134 and segment boundary line 136. As seen in FIG. 6, the annular outer liner radial wall 146 includes the plurality of outer liner swirl vanes 115 disposed on the downstream side 158 of the annular outer liner radial wall 146. The plurality of outer liner swirl vanes 115 may be circumferentially spaced apart from one another a circumferential distance 160. The circumferential distance 160 between consecutive outer liner swirl vanes 115 defines an outer liner slot dilution opening flow passage 154 between the consecutive outer liner swirl vanes 115. In addition, the outer liner swirl vanes 115 may be arranged at an angle 156 with respect to the radial direction and the circumferential direction. The angle 156 may be set based on an amount of swirl desired in the flow of the compressed air 82(*d*) through the annular outer liner slot dilution opening 114 (FIG. 4). In FIG. 6, which is an aft forward-looking view of the outer liner swirl vanes 115, the angle 156 is shown such that the outer liner swirl vanes 115 induce a clockwise flow of the compressed air 82(*d*) about the combustor centerline 112, which may be co-directional or counter-directional to the swirl direction 87 of the swirled fuel-air mixture 85 (FIG. 2). Of course, the angle 156 of the outer liner swirl vanes 115 may be set to provide a counter-clockwise flow of the compressed air 82(*d*) about the combustor centerline 112 (FIG. 4). While the circumferential distance 160 and the angle 156 of each of the plurality of outer liner swirl vanes 115 shown in FIG. 6 may appear to be the same, as will be described below, the angle 156 and the circumferential distance 160 may be varied between each outer liner swirl vane 115.

Figure 7:
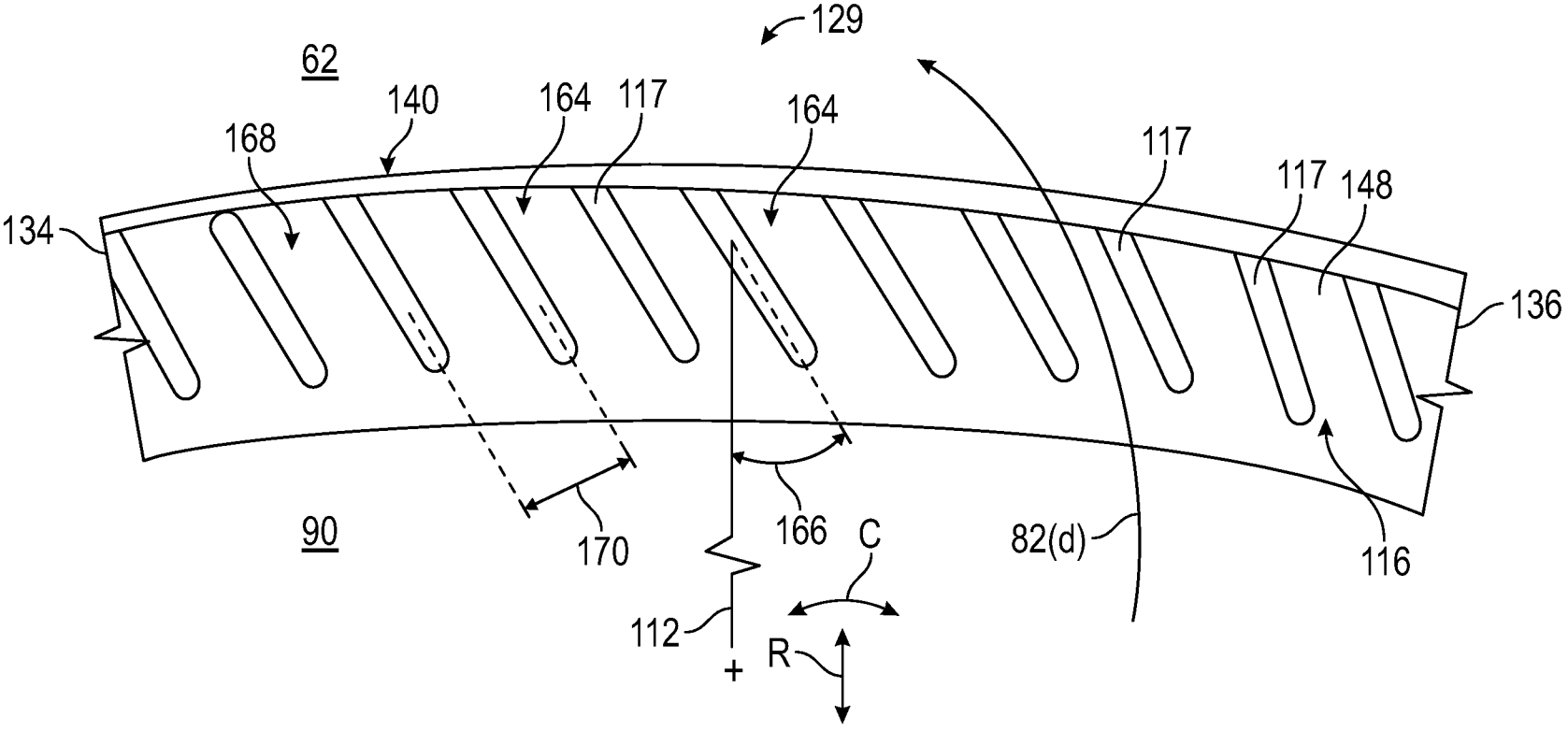
FIG. 7 is a partial cross-sectional view through the annular inner liner slot dilution opening 116 taken at plane 7-7 of FIG. 4, according to an aspect of the present disclosure.

FIG. 7 is a partial cross-sectional view through the annular inner liner slot dilution opening 116 taken at plane 7-7 of FIG. 4. In FIG. 7, the cross section may correspond to the first segment inner liner 140 of the first segment 129 (FIG. 3) between segment boundary line 134 and segment boundary line 136. As seen in FIG. 7, the annular inner liner radial wall 148 includes the plurality of inner liner swirl vanes 117 disposed on a downstream side 168 of the annular inner liner radial wall 148. The plurality of inner liner swirl vanes 117 may be circumferentially spaced apart from one another a circumferential distance 170. The circumferential distance 170 between consecutive inner liner swirl vanes 117 defines an inner liner slot dilution opening flow passage 164 between the consecutive inner liner swirl vanes 117. In addition, the inner liner swirl vanes 117 may be arranged at an angle 166 with respect to the radial direction and the circumferential direction. The angle 166 may be set based on an amount of swirl desired in the flow of the compressed air 82(*d*) through the annular inner liner slot dilution opening 116 (FIG. 4). In FIG. 7, which is an aft forward-looking view of the inner liner swirl vanes 117, the angle 166 is shown such that, the inner liner swirl vanes 117 induce a counter-clockwise flow of the compressed air 82(*d*) about the combustor centerline 112 (FIG. 4), which, as with the outer liner swirl vanes 115 (FIG. 6), may be co-directional or counter-directional with the swirl direction 87 of the swirled fuel-air mixture 85 (FIG. 2). Of course, the angle 166 of the inner liner swirl vanes 117 may be set to provide a clockwise flow of the compressed air 82(*d*) about the combustor centerline 112. When the inner liner swirl vanes 117 are aligned as shown in FIG. 7, and the outer liner swirl vanes 115 are aligned as shown in FIG. 6, the swirled flow of the compressed air 82(*d*) provided by the annular outer liner slot dilution opening 114 and the swirled flow of the compressed air 82(*d*) provided by the annular inner liner slot dilution opening 116 are counter-directional flows. Of course, the outer liner swirl vanes 115 and the inner liner swirl vanes 117 can be arranged so the annular outer liner slot dilution opening 114 and the annular inner liner slot dilution opening 116 provide co-directional flows of the compressed air 82(*d*). While the circumferential distance 170 and the angle 166 of each of the plurality of inner liner swirl vanes 117 shown in FIG. 7 may appear to be the same, as will be described below, the angle 166 and the circumferential distance 170 may be varied between each inner liner swirl vane 117.

Figure 8:
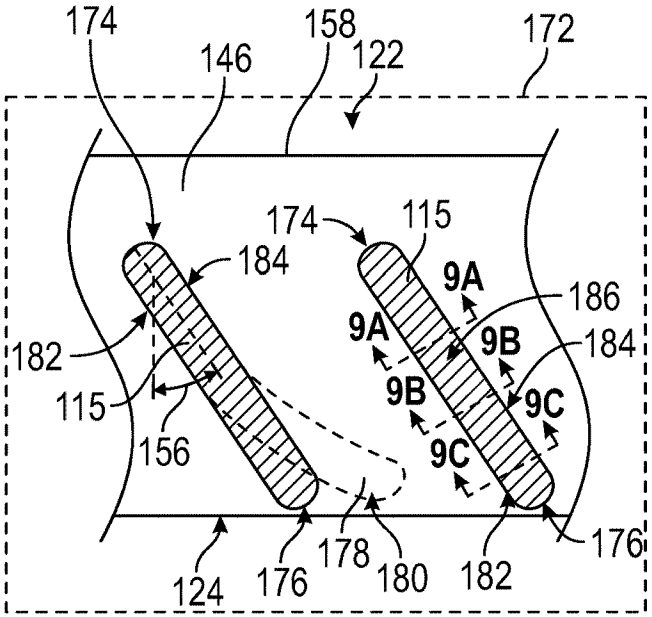
FIG. 8 is a close up view of the outer liner swirl vanes taken at detail 172 of FIG. 6, according to an aspect of the present disclosure.

FIG. 8 is a close up view of the outer liner swirl vanes 115 taken at detail 172 of FIG. 6. As seen in FIG. 8, the outer liner swirl vanes 115 may be linear vanes that have a linear profile extending between an outer liner swirl vane inlet end 174 to an outer liner swirl vane trailing end 176. In addition, a first outer liner swirl vane sidewall 182 and a second outer liner swirl vane sidewall 184 may extend in the axial direction (e.g., perpendicular to the downstream side 158 of the annular outer liner radial wall 146). Alternatively, rather than being linear swirl vanes, the outer liner swirl vanes 115 may be outer liner curved swirl vanes 178, where a trailing end 180 may have a curved profile rather than the linear profile of the outer liner swirl vane 115.

Figure 9C:
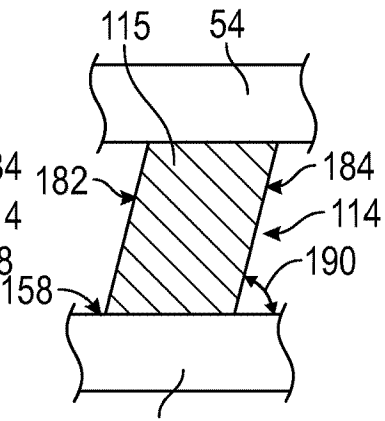
FIGS. 9A to 9C depict another alternative arrangement of the outer liner swirl vanes, according to an aspect of the present disclosure.
Figure 9B:
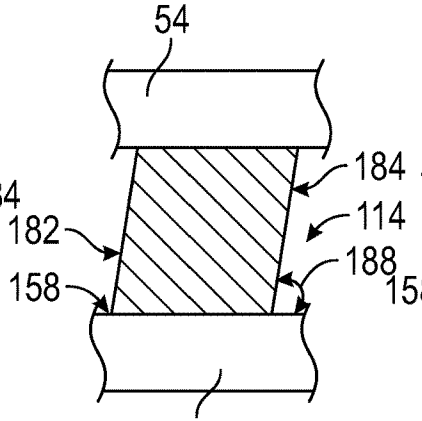
Figure 9A:
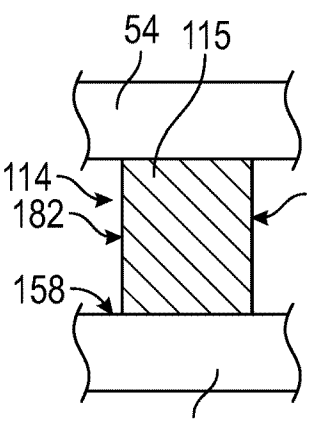

FIGS. 9A to 9C depict another alternative arrangement of the outer liner swirl vanes 115. In more detail, FIGS. 9A to 9C depict cross-sectional views through the linear profile outer liner swirl vane 115 of FIG. 8 as it extends in the axial direction from the annular outer liner radial wall 146 to the outer liner 54 within the annular outer liner slot dilution opening 114. In FIGS. 9A to 9C, rather than the first outer liner swirl vane sidewall 182 and the second outer liner swirl vane sidewall 184 extending perpendicular to the downstream side 158 of the annular outer liner radial wall 146 along the entire length from the outer liner swirl vane inlet end 174 to the outer liner swirl vane trailing end 176 (FIG. 8), the sidewalls 182/184 may have a gradually increasing inclination along the length of the outer liner swirl vane 115. Thus, in FIG. 9A, which is a cross section taken near the outer liner swirl vane inlet end 174, the first outer liner swirl vane sidewall 182 and the second outer liner swirl vane sidewall 184 may be perpendicular to the downstream side 158 of the annular outer liner radial wall 146. However, at a middle portion 186 of the outer liner swirl vane 115, as seen in FIG. 9B, the first outer liner swirl vane sidewall 182 and the second outer liner swirl vane sidewall 184 may be inclined at an angle 188 with respect to the downstream side 158 of the annular outer liner radial wall 146. In FIG. 9C, a cross section taken near the outer liner swirl vane trailing end 176, the first outer liner swirl vane sidewall 182 and the second outer liner swirl vane sidewall 184 may be included at an angle 190 with respect to the downstream side 158 of the annular outer liner radial wall 146, where the angle 190 is steeper than the angle 188. While the foregoing description of FIGS. 8 and 9A to 9C were made with regard to the outer liner swirl vanes 115, it can be readily understood those aspects are equally applicable to the inner liner swirl vanes 117. Therefore, a description of the inner liner swirl vanes 117 is omitted herein.

Figures 10A, 10B, 10C:
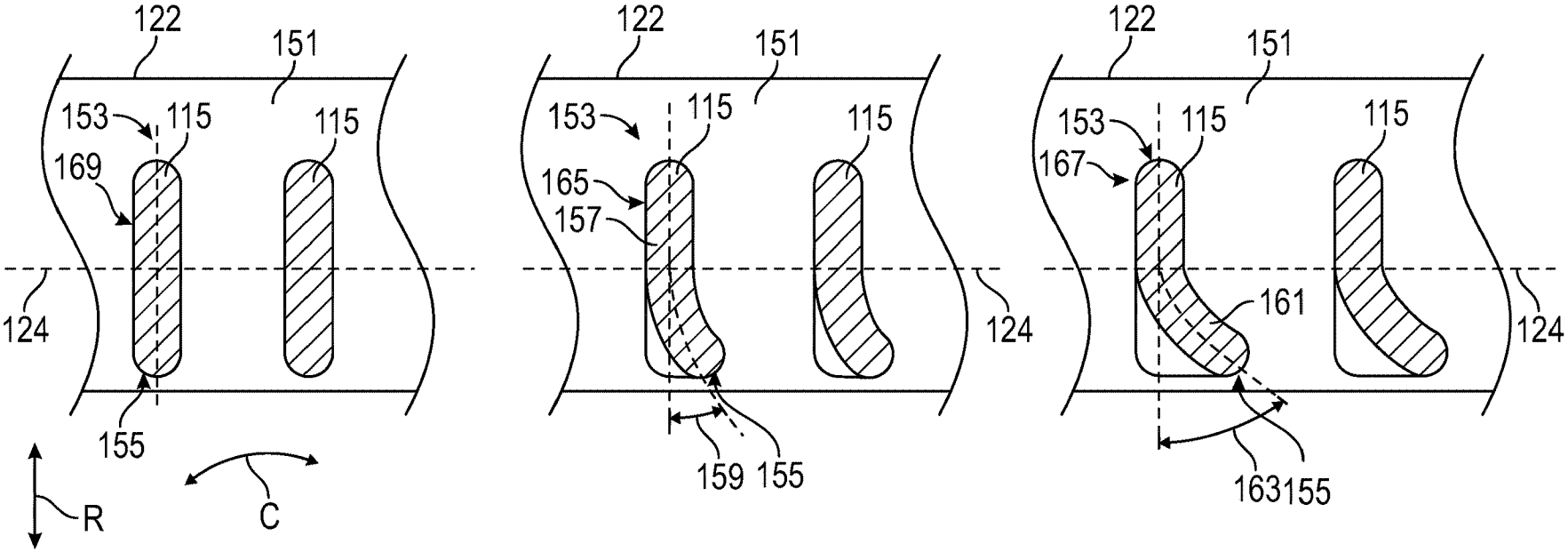
FIGS. 10A to 10C depict cross-sectional views through an outer liner swirl vane, according to an aspect of the present disclosure.

FIGS. 10A to 10C depict another alternative arrangement of the outer liner swirl vanes 115. In more detail, FIGS. 10A to 10C depict cross-sectional views through the linear profile outer liner swirl vane 115 of FIG. 5 as it extends in the axial direction from the annular outer liner radial wall 146 to the outer liner 54 within the annular outer liner slot dilution opening 114. The cross-sections of the outer liner swirl vanes 115 shown in FIGS. 10A to 10C are taken through the same outer liner swirl vane 115, but at different axial positions through the swirl vane 115. Thus, for example, the cross sections through the outer liner swirl vane 115 on the left-hand side of each of FIGS. 10A to 10C are of the same swirl vane 115. FIG. 10A is a cross section taken of a lengthwise downstream portion 169 at the downstream side 151 of the annular outer liner slot dilution opening 114. As shown in FIG. 10A, near the downstream side 151, the outer liner swirl vane 115 is arranged radially (i.e., extending in the radial direction R) between an inlet end 153 of the outer liner swirl vane 115 and an outlet end 155 of the outer liner swirl vane 115. Thus, the flow of the compressed air 82(*d*) through the annular outer liner slot dilution opening 114 (FIG. 4) near the downstream side 151 can keep the flow closer to the downstream side, and help to reduce the swirl on downstream side of annular outer liner slot dilution opening 114 to prevent scrubbing of hot gases on the outer liner hot side surface 124 (FIG. 4) of the outer liner.

In a mid-portion 165 of outer liner swirl vane 115 as shown in the cross section of FIG. 10B, however, a curved portion 157 is included in the outer liner swirl vane 115 toward the outlet end 155. The curved portion 157 of the mid-portion 165 may be arranged at an angle 159 so as to induce a swirl into the flow of the compressed air 82(*d*) (FIG. 5) with a first swirl number. In an upstream portion 167 of the outer liner swirl vane 115 near the upstream side 150 of the annular outer liner slot dilution opening 114, as shown in FIG. 10C, a second curved portion 161 may be included toward the outlet end 155, and an angle 163 of the second curved portion 161 may be set so as to induce a swirl into the flow of the compressed air 82(*d*) at the upstream end 150 (FIG. 5) with a second swirl number that is greater than the first swirl number.

Figure 11:
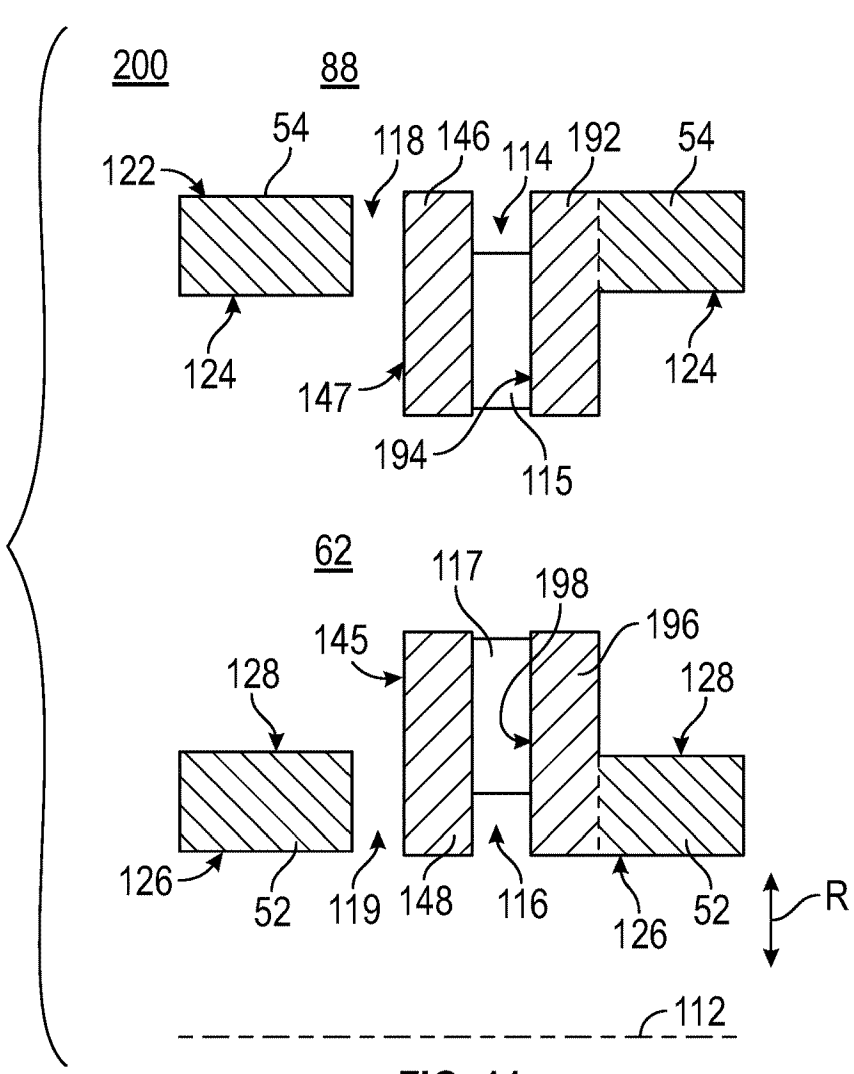
FIG. 11 depicts another arrangement of the outer liner and inner liner slot dilution openings and swirl vanes, taken at detail view 200 of FIG. 4, according to another aspect of the present disclosure.

FIG. 11 depicts another arrangement of the outer liner and inner liner slot dilution openings and swirl vanes, taken at detail view 200 of FIG. 4, according to another aspect of the present disclosure. In FIG. 11, the outer liner 54 includes the annular outer liner slot dilution opening 114, the plurality of outer liner swirl vanes 115 disposed therein, the second annular outer liner slot dilution opening 118, and the annular outer liner radial wall 146. In the FIG. 11 arrangement, however, a second annular outer liner radial wall 192 is disposed at a downstream side 194 of the annular outer liner slot dilution opening 114. The annular outer liner radial wall 146 and the second annular outer liner radial wall 192 of FIG. 11 extend radially into the combustion chamber 62 perpendicular to the axial direction, and the plurality of outer liner swirl vanes 115 are disposed between the annular outer liner radial wall 146 and the second annular outer liner radial wall 192.

Similarly, in FIG. 11, the inner liner 52 includes the annular inner liner slot dilution opening 116, the plurality of inner liner swirl vanes 117 disposed therein, the second annular inner liner slot dilution opening 119 disposed on an upstream side 145 of the annular inner liner radial wall 148, and the annular inner liner radial wall 148. In the FIG. 11 arrangement, however, a second annular inner liner radial wall 196 is disposed at a downstream side 198 of the annular inner liner slot dilution opening 116. The annular inner liner radial wall 148 and the second annular inner liner radial wall 196 of FIG. 11 extend radially into the combustion chamber 62 perpendicular to the axial direction, and the plurality of inner liner swirl vanes 117 are disposed between the annular inner liner radial wall 148 and the second annular inner liner radial wall 196.

Figure 12:
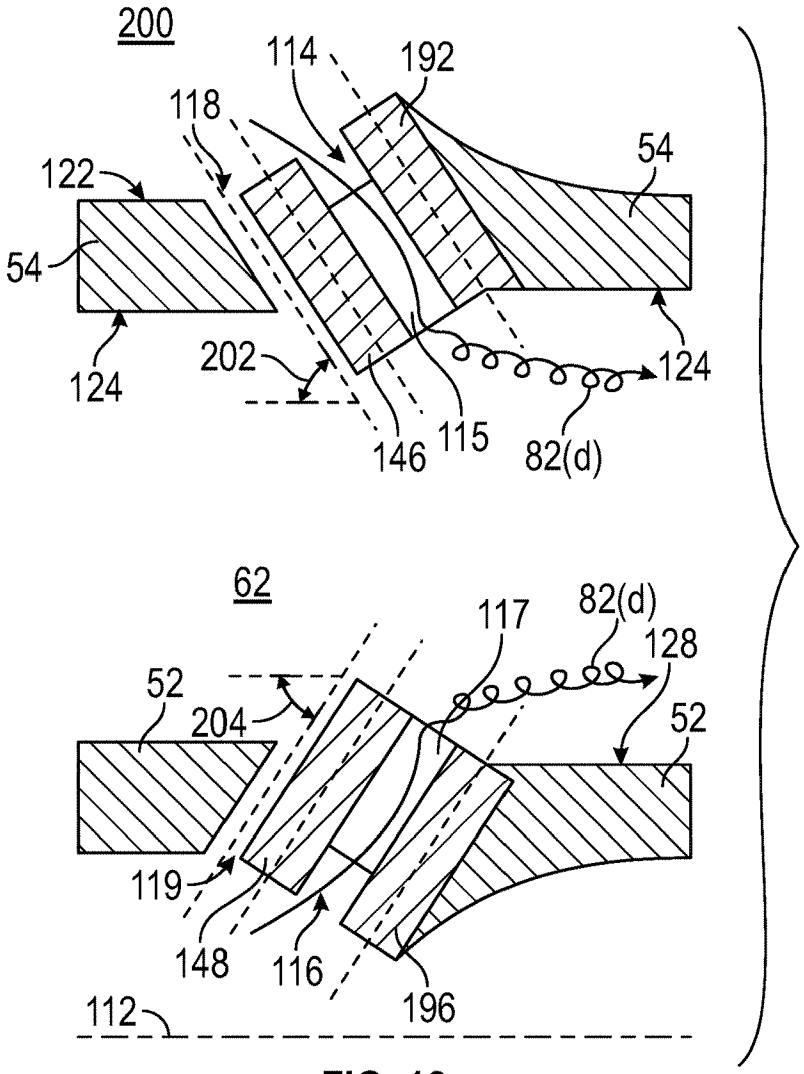
FIG. 12 depicts yet another arrangement of the outer liner and inner liner slot dilution openings and swirl vanes, taken at detail view 200 of FIG. 4, according to another aspect of the present disclosure.

FIG. 12 depicts yet another arrangement of the outer liner and inner liner slot dilution openings and swirl vanes, taken at detail view 200 of FIG. 4, according to another aspect of the present disclosure. The FIG. 12 aspect, similar to the FIG. 11 aspect, includes the annular outer liner slot dilution opening 114, the plurality of outer liner swirl vanes 115, the annular outer liner radial wall 146, the second annular outer liner slot dilution opening 118, and the second annular outer liner radial wall 192. One difference, however, between the FIG. 12 aspect and the FIG. 11 aspect is that, rather than the foregoing elements being arranged perpendicular to the axial direction, they are instead aligned at a downstream angle 202 so as to provide the flow of compressed air 82(*d*) in the downstream direction within the combustion chamber 62. Thus, each of the annular outer liner slot dilution opening 114, the plurality of outer liner swirl vanes 115, the annular outer liner radial wall 146, the second annular outer liner slot dilution opening 118, and the second annular outer liner radial wall 192 are arranged at the downstream angle 202. With this aspect, the swirled flow of the compressed air 82(*d*) exiting the plurality of outer liner swirl vanes 115 may be provided closer to the outer liner hot surface side 124 of the outer liner 54 so as to provide surface cooling to the outer liner 54.

Similarly, as with the FIG. 11 aspect, the inner liner 52 includes the annular inner liner slot dilution opening 116, the plurality of inner liner swirl vanes 117, the annular inner liner radial wall 148, the second annular inner liner slot dilution opening 119, and the second annular inner liner radial wall 196. One difference, however, between the FIG. 12 aspect and the FIG. 11 aspect is that, rather than the foregoing elements being arranged perpendicular to the axial direction, they are instead aligned at a downstream angle 204. Thus, each of the annular inner liner slot dilution opening 116, the plurality of inner liner swirl vanes 117, the annular inner liner radial wall 148, the second annular inner liner slot dilution opening 119, and the second annular inner liner radial wall 196 are arranged at the downstream angle 204. With this aspect, the swirled flow of the compressed air 82(*d*) exiting the plurality of inner liner swirl vanes 117 may be provided closer to the inner liner hot surface side 128 of the inner liner 52 so as to provide surface cooling to the inner liner 52.

Figure 13:
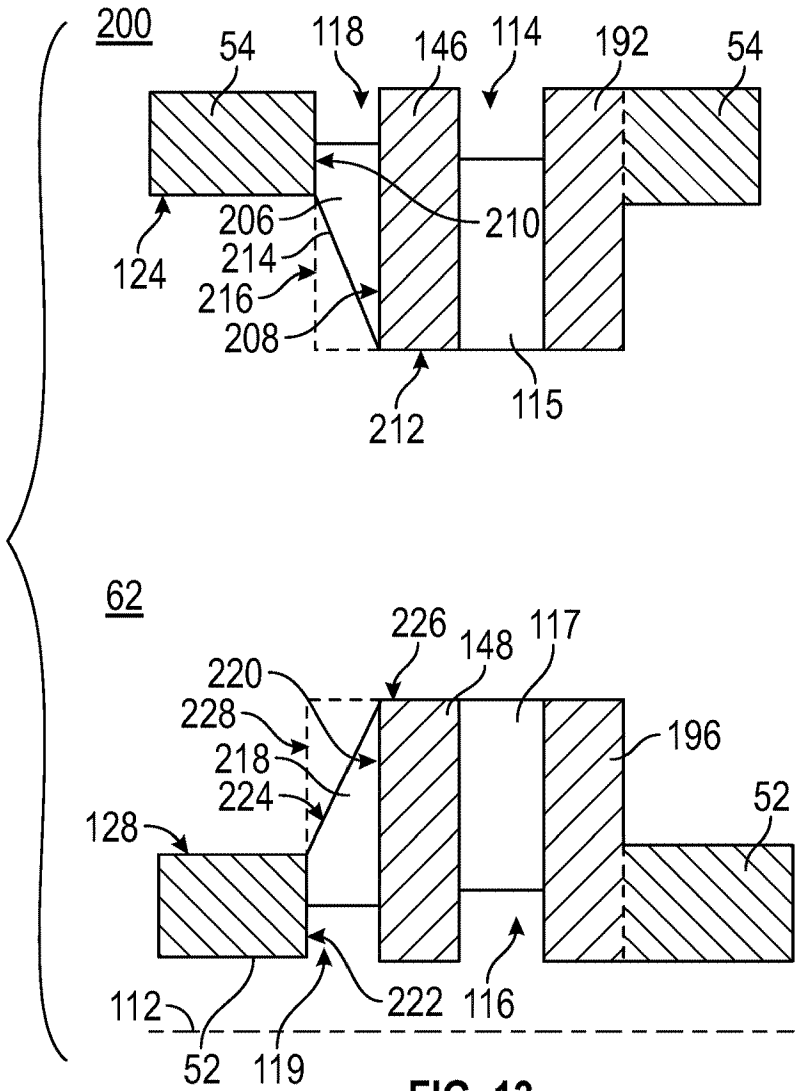
FIG. 13 depicts yet another arrangement of the outer liner and inner liner slot dilution openings and swirl vanes, taken at detail view 200 of FIG. 4, according to yet another aspect of the present disclosure.

FIG. 13 depicts yet another arrangement of the outer liner and inner liner slot dilution openings and swirl vanes, taken at detail view 200 of FIG. 4, according to yet another aspect of the present disclosure. The FIG. 13 aspect, as with the FIG. 11 aspect, the outer liner 54 includes the annular outer liner slot dilution opening 114, the plurality of outer liner swirl vanes 115, the annular outer liner radial wall 146, the second annular outer liner slot dilution opening 118, and the second annular outer liner radial wall 192. One difference, however, between the FIG. 13 aspect and the FIG. 11 aspect is that, a second plurality of outer liner swirl vanes 206 are disposed within the second annular outer liner slot dilution opening 118. Each of the second plurality of outer liner swirl vanes 206 may extend in the upstream direction from an upstream side 208 of the annular outer liner radial wall 146 to an upstream side 210 of the second annular outer liner slot dilution opening 118. The second plurality of outer liner swirl vanes 206 may include a tapered radially inward portion 214 that is tapered and extends from the outer liner hot surface side 124 at upstream side 210 of the second annular outer liner slot dilution opening 118 to the upstream side 208 of the annular outer liner radial wall 146 at a radially inner end 212 of the annular outer liner radial wall 146. Of course, the second plurality of outer liner swirl vanes 206 need not include the tapered radially inward portion 214, and may, instead, include an upstream edge 216 that extends radially inward to the radially inner end 212 of the annular outer liner radial wall 146.

Similarly, the inner liner 52 includes the annular inner liner slot dilution opening 116, the plurality of inner liner swirl vanes 117, the annular inner liner radial wall 148, the second annular inner liner slot dilution opening 119, and the second annular inner liner radial wall 196. One difference, however, between the FIG. 13 aspect and the FIG. 11 aspect is that a second plurality of inner liner swirl vanes 218 are disposed within the second annular inner liner slot dilution opening 119. Each of the second plurality of inner liner swirl vanes 218 may extend in the upstream direction from an upstream side 220 of the annular inner liner radial wall 148 to an upstream side 222 of the second annular inner liner slot dilution opening 119. The second plurality of inner liner swirl vanes 218 may include a tapered radially outer portion 224 that is tapered from inner liner hot surface side 128 at the upstream side 222 of the second annular inner liner slot dilution opening to the upstream side 220 of the annular inner liner radial wall 148 at a radially outer end 226 of the annular inner liner radial wall 148. Of course, the second plurality of inner liner swirl vanes 218 need not be tapered, and, instead, may include an upstream edge 228 that extends radially inward to the radially outer end 226 of the annular inner liner radial wall 148.

Figure 14:
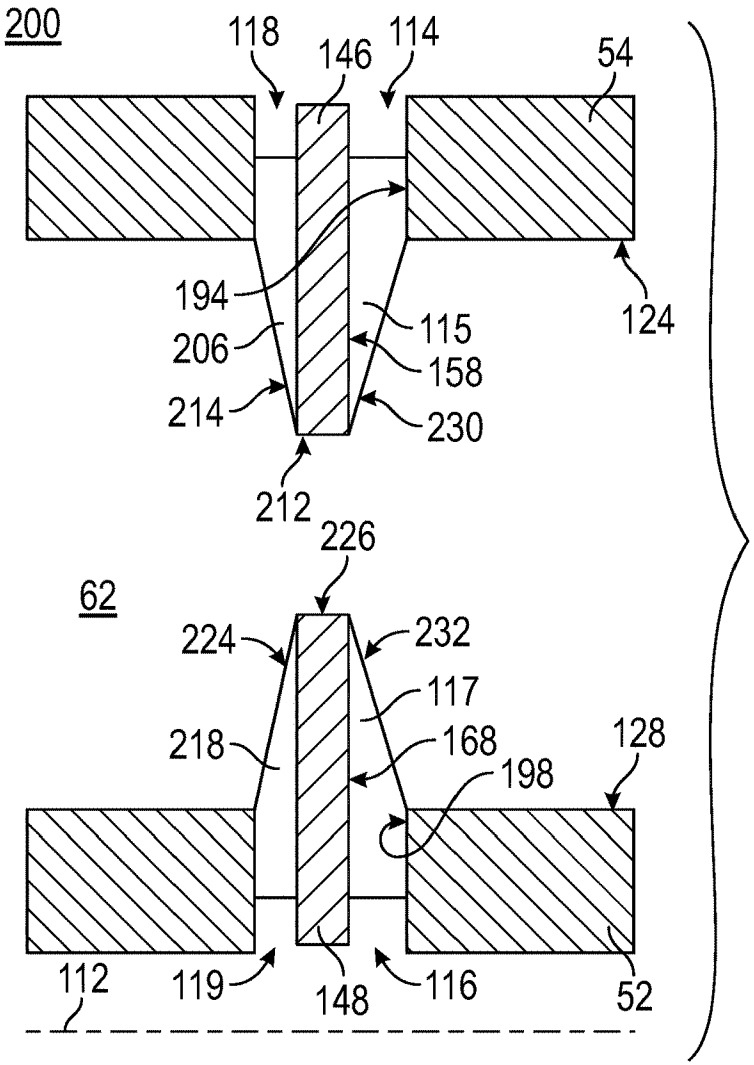
FIG. 14 depicts yet another arrangement of the outer liner and inner liner slot dilution openings and swirl vanes, taken at detail view 200 of FIG. 4, according to yet another aspect of the present disclosure.

FIG. 14 depicts yet another arrangement of the outer liner and inner liner slot dilution openings and swirl vanes, taken at detail view 200 of FIG. 4, according to yet another aspect of the present disclosure. The outer liner 54 aspect of FIG. 14 includes the annular outer liner slot dilution opening 114 having the plurality of outer liner swirl vanes 115 disposed therein, the annular outer liner radial wall 146, the second annular outer liner slot dilution opening 118 and the second plurality of outer liner swirl vanes 206 disposed therein. The second plurality of outer liner swirl vanes 206 include the tapered radially inward portion 214, as described above. The plurality of outer liner swirl vanes 115 include a tapered radially inner portion 230 that extends from the downstream side 194 of the annular outer liner slot dilution opening 114 at the outer liner hot surface side 124 to the radially inner end 212 of the annular outer liner radial wall 146 at the downstream side 158 of the annular outer liner radial wall 146. This is similar to the arrangement of the plurality of outer liner swirl vanes 115 depicted in FIG. 4.

Similarly, the inner liner 52 in the aspect of FIG. 14 includes the annular inner liner slot dilution opening 116 having the plurality of inner liner swirl vanes 117 disposed therein, the annular inner liner radial wall 148, the second annular inner liner slot dilution opening 119 and the second plurality of inner liner swirl vanes 218 disposed therein. The second plurality of inner liner swirl vanes 218 include the tapered radially outer portion 224, as described above. The plurality of inner liner swirl vanes 117 include a tapered radially inner portion 232 that extends from the downstream side 198 of the annular inner liner slot dilution opening 116 at the inner liner hot surface side 128 to the radially outer end 226 of the annular inner liner radial wall 148 at the downstream side 168 of the annular inner liner radial wall 148.

Figure 15:
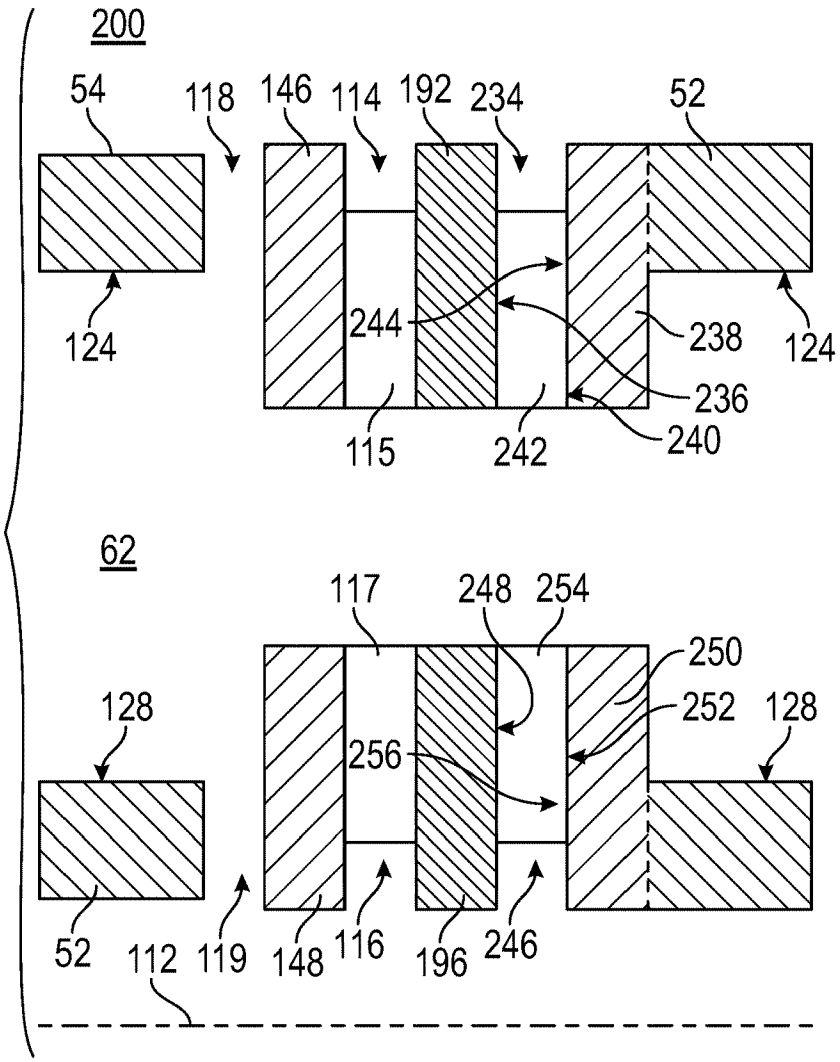
FIG. 15 depicts yet another arrangement of the outer liner and inner liner slot dilution openings and swirl vanes, taken at detail view 200 of FIG. 4, according to yet another aspect of the present disclosure.

FIG. 15 depicts yet another arrangement of the outer liner and inner liner slot dilution openings and swirl vanes, taken at detail view 200 of FIG. 4, according to yet another aspect of the present disclosure. The outer liner 54 of the FIG. 15 aspect, as with the FIG. 11 aspect, includes the annular outer liner slot dilution opening 114 having the plurality of outer liner swirl vanes 115 disposed therein, the annular outer liner radial wall 146, the second annular outer liner radial wall 192, and the second annular outer liner slot dilution opening 118. Each of these elements is the same as the corresponding elements described with regard to FIG. 11. In FIG. 15, however, the outer liner 54 further includes a third annular outer liner slot dilution opening 234 at a downstream side 236 of the second annular outer liner radial wall 192, and a third annular outer liner radial wall 238 disposed at a downstream side 240 of the third annular outer liner slot dilution opening 234 and extending radially into the combustion chamber 62 perpendicular to the axial direction. A second plurality of outer liner swirl vanes 242 are disposed in the third annular outer liner slot dilution opening 234 between the downstream side 236 of the second annular outer liner radial wall 192 and an upstream side 244 of the third annular outer liner radial wall 238. The first plurality of outer liner swirl vanes 115 and the second plurality of outer liner swirl vanes 242 may have either a co-swirl direction with respect to one another, or may have a counter-swirl direction with respect to one another. In addition, the first plurality of outer liner swirl vanes 115 may be arranged in a co-swirl direction or a counter-swirl direction with the swirl direction 87 of the swirled fuel-air mixture 85 (FIG. 2), and the second plurality of outer liner swirl vanes 242 may be arranged in a co-swirl direction or a counter-swirl direction with the swirl direction of the swirled fuel-air mixture 85.

In FIG. 15, the inner liner 52 is also the same as that depicted in FIG. 11, but further includes a third annular inner liner slot dilution opening 246 at a downstream side 248 of the second annular inner liner radial wall 196, a third annular inner liner radial wall 250 disposed at a downstream side 252 of the third annular inner liner slot dilution opening 246 and extending radially into the combustion chamber 62 perpendicular to the axial direction. A second plurality of inner liner swirl vanes 254 are disposed in the third annular inner liner slot dilution opening 246 arranged between the downstream side 248 of the second annular inner liner radial wall 196 and an upstream side 256 of the third annular inner liner radial wall 250. The first plurality of inner liner swirl vanes 117 and the second plurality of inner liner swirl vanes 254 may have either a co-swirl direction with respect to one another, or may have a counter-swirl direction with respect to one another. In addition, the first plurality of inner liner swirl vanes 117 may be arranged in a co-swirl direction or a counter-swirl direction with the swirl direction of the swirled fuel-air mixture 85, and the second plurality of inner liner swirl vanes 254 may be arranged in a co-swirl direction or a counter-swirl direction with the swirl direction of the swirled fuel-air mixture 85.

Figure 16:
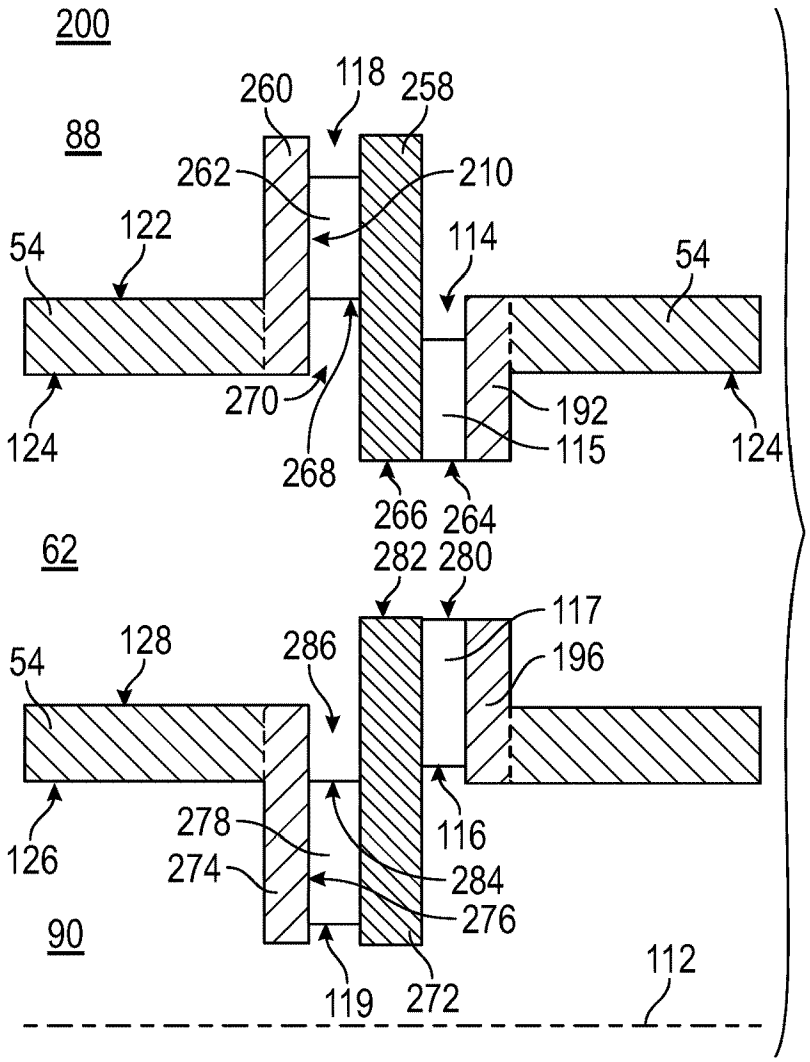
FIG. 16 depicts still another arrangement of the outer liner and inner liner slot dilution openings and swirl vanes, taken at detail view 200 of FIG. 4, according to still another aspect of the present disclosure.

FIG. 16 depicts still another arrangement of the outer liner and inner liner slot dilution openings and swirl vanes, taken at detail view 200 of FIG. 4, according to still another aspect of the present disclosure. The outer liner 54 of the FIG. 16 aspect includes the annular outer liner slot dilution opening 114 having the plurality of outer liner swirl vanes 115 disposed therein, the second annular outer liner slot dilution opening 118, and the second annular outer liner radial wall 192. The outer liner 54 of FIG. 16 also includes an annular outer liner radial wall 258 that is similar to the annular outer liner radial wall 146, but which further extends into the outer flow passage 88 on the outer liner cold surface side 122 of the outer liner 54. The outer liner 54 further includes a third annular outer liner radial wall 260 extending radially outward from the outer liner cold surface side 122 at upstream side 210 of the second annular outer liner slot dilution opening 118 into the outer flow passage 88. A second plurality of outer liner swirl vanes 262 are disposed in the second annular outer liner slot dilution opening 118 between the annular outer liner radial wall 258 and the third annular outer liner radial wall 260. Trailing edges 264 of each of the plurality of outer liner swirl vanes 115 are disposed adjacent to a radially inner end 266 of the annular outer liner radial wall 258, and trailing edges 268 of each of the second plurality of outer liner swirl vanes 262 are disposed adjacent to the outer liner cold surface side 122. Thus, a radially inner portion 270 of the second annular outer liner slot dilution opening 118 can be free of swirl vanes and prevent flame holding at the trailing edge 268 of the second plurality of outer liner swirl vanes 262. Additionally, the flow of the compressed air 82(*c*) (FIG. 5) from the second annular outer liner slot dilution opening 118 can shield the trailing edge 264 of the plurality of outer liner swirl vanes 115 so that flame holding at the trailing edge 264 can be prevented.

The inner liner 52 of the FIG. 16 aspect includes the annular inner liner slot dilution opening 116 having the plurality of inner liner swirl vanes 117 disposed therein, the second annular inner liner slot dilution opening 119, and the second annular inner liner radial wall 196. The inner liner 52 of FIG. 16 also includes an annular inner liner radial wall 272 that is similar to the annular inner liner radial wall 148, but which further extends into the inner flow passage 90 on the inner liner cold surface side 126 of the inner liner 52. The inner liner 52 further includes a third annular inner liner radial wall 274 extending radially inward from the inner liner cold surface side 126 at an upstream end 276 of the second annular inner liner slot dilution opening 119 into the inner flow passage 90. A second plurality of inner liner swirl vanes 278 are disposed in the second annular inner liner slot dilution opening 119 between the annular inner liner radial wall 272 and the third annular inner liner radial wall 274. Trailing edges 280 of each of the plurality of inner liner swirl vanes 117 are disposed adjacent to a radially outer end 282 of the annular inner liner radial wall 272, and trailing edges 284 of each of the second plurality of inner liner swirl vanes 278 are disposed adjacent to the inner liner cold surface side 126. Thus, a radially outer portion 286 of the second annular inner liner slot dilution opening 119 can be free of swirl vanes and prevent flame holding at the trailing edge 284 of the second plurality of inner liner swirl vanes 278. Additionally, the flow of the compressed air 82(*c*) (FIG. 5) from the second annular inner liner slot dilution opening 119 can shield the trailing edge 280 of the plurality of inner liner swirl vanes 117 so that flame holding at the trailing edge 280 can be prevented.

Figure 17:
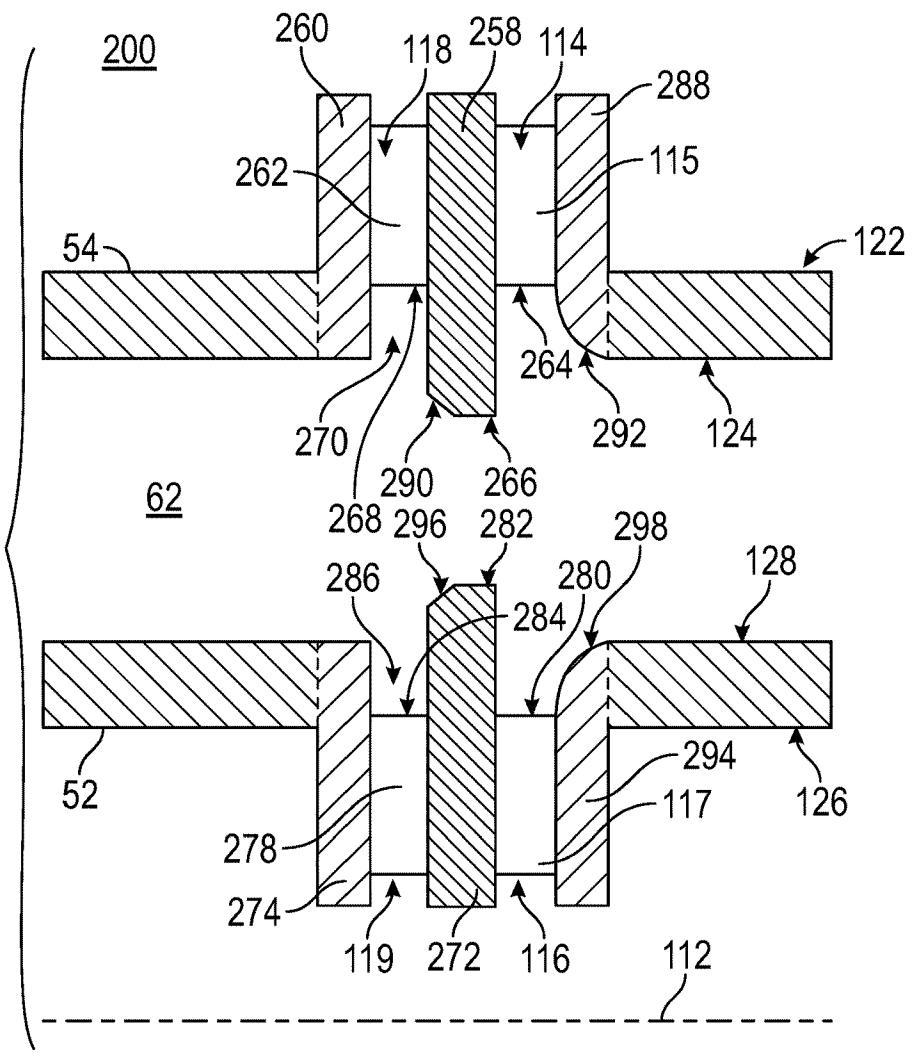
FIG. 17 depicts still another arrangement of the outer liner and inner liner slot dilution openings and swirl vanes, taken at detail view 200 of FIG. 4, according to still another aspect of the present disclosure.

FIG. 17 depicts still another arrangement of the outer liner and inner liner slot dilution openings and swirl vanes, taken at detail view 200 of FIG. 4, according to still another aspect of the present disclosure. The FIG. 17 aspect is similar to that of FIG. 16 and, therefore, like reference numerals will not be described again herein. One difference, however, between the FIG. 17 aspect of the outer liner 54 and the FIG. 16 aspect relates to the second annular outer liner radial wall 192 of FIG. 16. In FIG. 16, the second annular outer liner radial wall 192 extends radially inward from the outer liner hot surface side 124 of the outer liner 54. In FIG. 17, in contrast, a second annular outer liner radial wall 288 extends radially outward from the outer liner cold surface side 122 into the outer flow passage 88. In addition, rather than the trailing edge 264 of the plurality of outer liner swirl vanes 115 extending to the radially inner end 266 of the annular outer liner radial wall 258, the trailing edge 264 in FIG. 17 is disposed adjacent to the outer liner cold surface side 122, the same as the trailing edge 268 of the second plurality of outer liner swirl vanes 262. In addition, the radially inner end 266 of the annular outer liner radial wall 258 may be rounded or chamfered at an upstream side 290, while the second annular outer liner radial wall 288 may also be rounded or chamfered at its radially inner end 292.

The inner liner 52 of FIG. 17 is also similar to that of FIG. 16 and, therefore, like reference numerals will not be described again herein. One difference, however, between the FIG. 17 aspect of the inner liner 52 and the FIG. 16 aspect relates to the second annular inner liner radial wall 196 of FIG. 15. In FIG. 16, the second annular inner liner radial wall 196 extends radially outward from the outer liner hot surface side 124 of the inner liner 54 into the combustion chamber 62. In FIG. 17, in contrast, a second annular inner liner radial wall 294 extends radially inward from the inner liner cold surface side 126 into the inner flow passage 90. In addition, rather than the trailing edge 280 of the plurality of inner liner swirl vanes 117 extending to the radially outer end 282 of the annular inner liner radial wall 272, the trailing edge 280 in FIG. 17 is disposed adjacent to the inner liner cold surface side 126, the same as the trailing edge 284 of the second plurality of inner liner swirl vanes 278. In addition, the radially outer end 282 of the annular inner liner radial wall 272 may be rounded or chamfered at an upstream side 296, while the second annular inner liner radial wall 294 may also be rounded or chamfered at its radially outer end 298.

Figure 18:
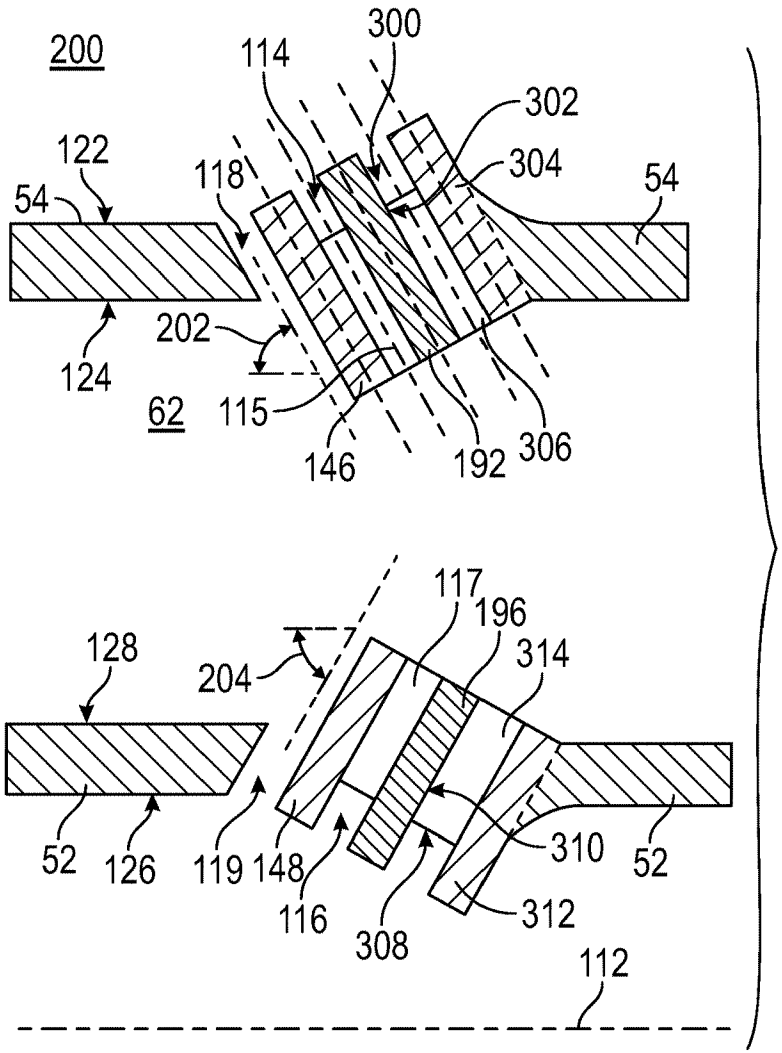
FIG. 18 depicts still another arrangement of the outer liner and inner liner slot dilution openings and swirl vanes, taken at detail view 200 of FIG. 4, according to still another aspect of the present disclosure.

FIG. 18 depicts still another arrangement of the outer liner and inner liner slot dilution openings and swirl vanes, taken at detail view 200 of FIG. 4, according to still another aspect of the present disclosure. The FIG. 18 aspect is similar to the FIG. 11 aspect and therefore, like reference numerals that are the same will not be discussed again herein. Some differences between the outer liner 54 of the FIG. 18 aspect from the FIG. 11 aspect, however, are the inclusion of a third annular outer liner slot dilution opening 300 disposed at a downstream side 302 of the second annular outer liner radial wall 192, and having a second plurality of outer liner swirl vanes 306 disposed therein, and a third annular outer liner radial wall 304. The foregoing differences are similar to the FIG. 15 aspect. As with the FIG. 11 aspect, however, the third annular outer liner slot dilution opening 300 and the second plurality of outer liner swirl vanes 306 disposed therein, and the third annular outer liner radial wall 304, are all arranged at the downstream angle 202.

The FIG. 18 aspect of the inner liner 52 is also similar to the FIG. 11 aspect and, therefore, like reference numerals that are the same will not be discussed again herein. Some differences between the inner liner 52 of the FIG. 18 aspect from the FIG. 11 aspect, however, are the inclusion of a third annular inner liner slot dilution opening 308 disposed at a downstream side 310 of the second annular inner liner radial wall 196, and having a second plurality of inner liner swirl vanes 314 disposed therein, and a third annular inner liner radial wall 312. The foregoing differences are similar to the FIG. 15 aspect. As with the FIG. 11 aspect, however, the third annular inner liner slot dilution opening 308 and the second plurality of inner liner swirl vanes 314 disposed therein, and the third annular inner liner radial wall 312, are all arranged at the downstream angle 204.

Figure 19:
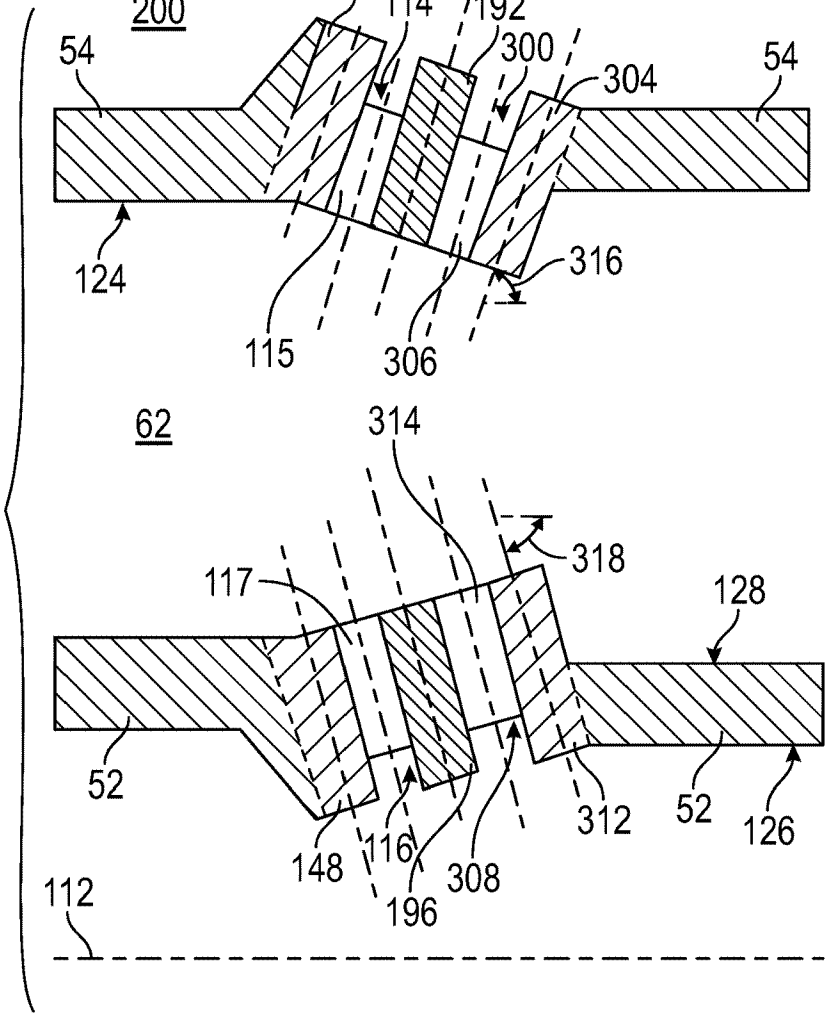
FIG. 19 depicts still another arrangement of the outer liner and inner liner slot dilution openings and swirl vanes, taken at detail view 200 of FIG. 4, according to still another aspect of the present disclosure.

FIG. 19 depicts still another arrangement of the outer liner and inner liner slot dilution openings and swirl vanes, taken at detail view 200 of FIG. 4, according to still another aspect of the present disclosure. The FIG. 19 aspect of both the outer liner 54 and the inner liner 52 is similar to the FIG. 18 aspect and, therefore, like reference numerals that are the same will not be discussed again herein. Some differences between the outer liner 54 and the inner liner 52 of the FIG. 19 aspect from the FIG. 18 aspect, however, are the omission of the second annular outer liner slot dilution opening 118, and the omission of the second annular inner liner slot dilution opening 119. In addition, the annular outer liner slot dilution opening 114, the third annular outer liner slot dilution opening 300, the annular outer liner radial wall 146, the second annular outer liner radial wall 192, and the third annular outer liner radial wall 304 are all arranged at an upstream angle 316 instead of at the downstream angle 202 (FIG. 18). Likewise, the annular inner liner slot dilution opening 116, the third annular inner liner slot dilution opening 308, the annular inner liner radial wall 148, the second annular inner liner radial wall 196, and the third annular inner liner radial wall 312 are all arranged at an upstream angle 318 instead of at the downstream angle 204 (FIG. 18).

Figure 20:
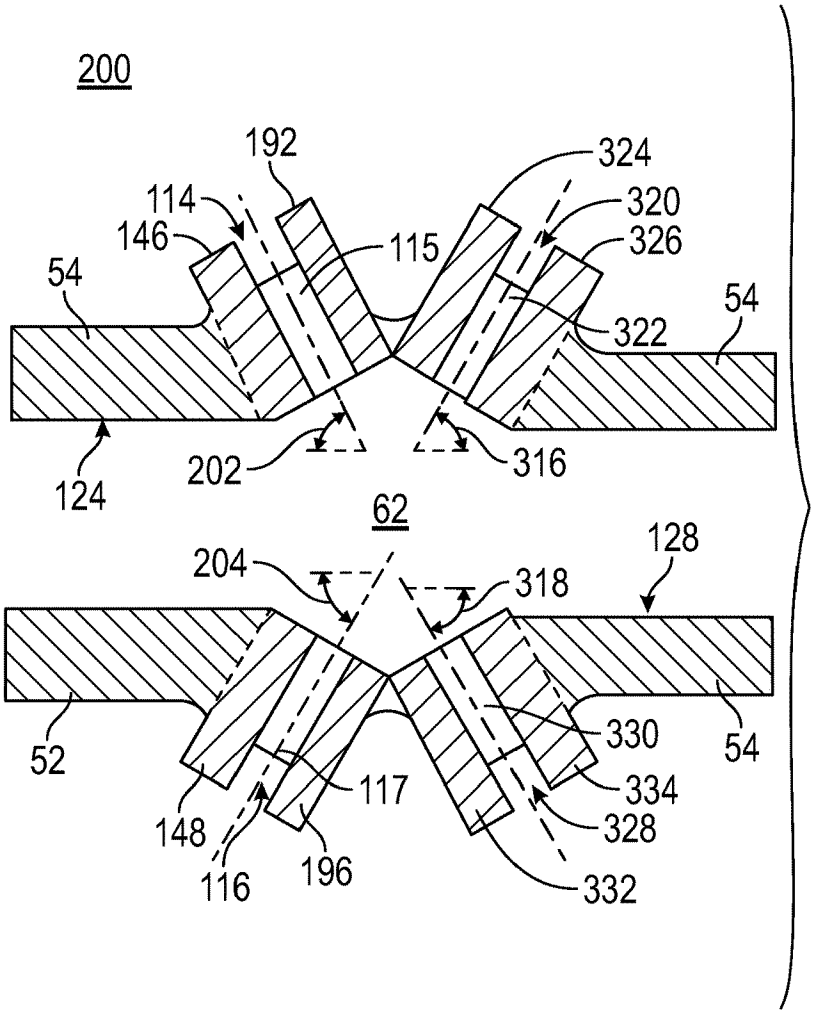
FIG. 20 depicts still another arrangement of the outer liner and inner liner slot dilution openings and swirl vanes, taken at detail view 200 of FIG. 4, according to still another aspect of the present disclosure.

FIG. 20 depicts still another arrangement of the outer liner and inner liner slot dilution openings and swirl vanes, taken at detail view 200 of FIG. 4, according to still another aspect of the present disclosure. The FIG. 20 aspect of the outer liner 54 includes the annular outer liner slot dilution opening 114 having the plurality of outer liner swirl vanes 115 disposed therein, the annular outer liner radial wall 146 and the second annular outer liner radial wall 192, each arranged at the downstream angle 202. The outer liner 54 further includes a second annular outer liner slot dilution opening 320 having a second plurality of outer liner swirl vanes 322 disposed therein, where the second annular outer liner slot dilution opening 320 is disposed between a third annular outer liner radial wall 324 and a fourth annular outer liner radial wall 326. The third annular outer liner radial wall 324 is disposed downstream of the second annular outer liner radial wall 192. The second annular outer liner slot dilution opening 320, the third annular outer liner radial wall 324 and the fourth annular outer liner radial wall 326 are each arranged at the upstream angle 316. Thus, the flow of the compressed air 82(*d*) through the annular outer liner slot dilution opening 114 and the flow of the compressed air 82(*d*) through the second annular outer liner slot dilution opening 320 converge with one another at the outer liner hot surface side 124 in the combustion chamber 62. In addition, the swirl direction of the plurality of outer liner swirl vanes 115 and the swirl direction of the second plurality of outer liner swirl vanes 322 may be in a same swirl direction with respect to one another, or may be in a counter-swirl direction with respect to one another.

Similarly, the inner liner 52 of the FIG. 20 aspect includes the annular inner liner slot dilution opening 116 having the plurality of inner liner swirl vanes 117 disposed therein, the annular inner liner radial wall 148 and the second annular inner liner radial wall 196, each arranged at the downstream angle 204. The inner liner 52 further includes a second annular inner liner slot dilution opening 328 having a second plurality of inner liner swirl vanes 330 disposed therein, where the second annular inner liner slot dilution opening 328 is disposed between a third annular inner liner radial wall 332 and a fourth annular inner liner radial wall 334. The third annular inner liner radial wall 332 is disposed downstream of the second annular inner liner radial wall 196. The second annular inner liner slot dilution opening 328, the third annular inner liner radial wall 332 and the fourth annular inner liner radial wall 334 are each arranged at the upstream angle 318. Thus, the flow of the compressed air 82(*d*) through the annular inner liner slot dilution opening 116 and the flow of the compressed air 82(*d*) through the second annular inner liner slot dilution opening 328 converge with one another at the inner liner hot surface side 128 in the combustion chamber 62. In addition, the swirl direction of the plurality of inner liner swirl vanes 117 and the swirl direction of the second plurality of inner liner swirl vanes 330 may be in a same swirl direction with respect to one another, or may be in a counter-swirl direction with respect to one another.

Figure 21:
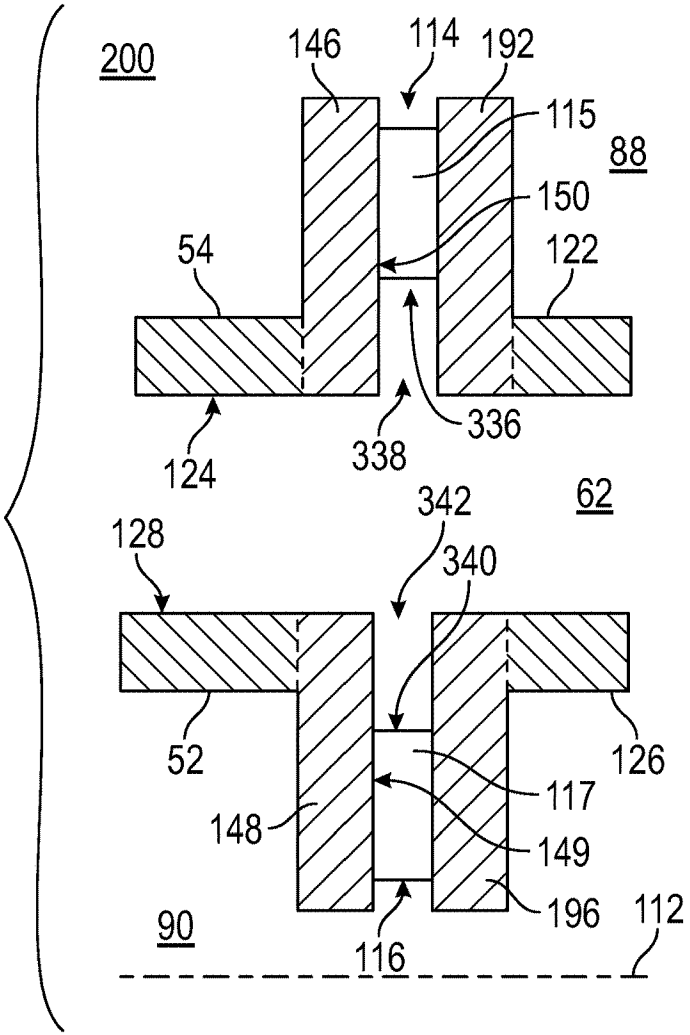
FIG. 21 depicts still another arrangement of the outer liner and inner liner slot dilution openings and swirl vanes, taken at detail view 200 of FIG. 4, according to still another aspect of the present disclosure.

FIG. 21 depicts still another arrangement of the outer liner and inner liner slot dilution openings and swirl vanes, taken at detail view 200 of FIG. 4, according to still another aspect of the present disclosure. The outer liner 54 of FIG. 21 includes the annular outer liner slot dilution opening 114 having the plurality of outer liner swirl vanes 115 disposed therein between annular outer liner radial wall 146 and second annular outer liner radial wall 192. In the FIG. 21 aspect, the annular outer liner radial wall 146 and the second annular outer liner radial wall 192 both extend radially outward from the outer liner cold surface side 122 into the outer flow passage 88. A trailing edge 336 of each of the plurality of outer liner swirl vanes 115 is seen to be disposed radially outward of the outer liner cold surface side 122, or may be arranged adjacent to the outer liner cold surface side 122. Thus, a radially inner portion 338 of the annular outer liner slot dilution opening 114 remains free of the swirl vanes so as to prevent flame holding at the trailing edge 336.

Similarly, the inner liner 52 of FIG. 21 includes the annular inner liner slot dilution opening 116 having the plurality of inner liner swirl vanes 117 disposed therein between annular inner liner radial wall 148 and second annular inner liner radial wall 196. In the FIG. 21 aspect, the annular inner liner radial wall 148 and the second annular inner liner radial wall 196 both extend radially inward from the inner liner cold surface side 126 into the inner flow passage 90. A trailing edge 340 of each of the plurality of inner liner swirl vanes 117 is seen to be disposed radially inward of the inner liner cold surface side 126, or may be arranged adjacent to the inner liner cold surface side 126. Thus, a radially inner portion 342 of the annular inner liner slot dilution opening 116 remains free of the swirl vanes so as to prevent flame holding at the trailing edge 340.

Figure 22:
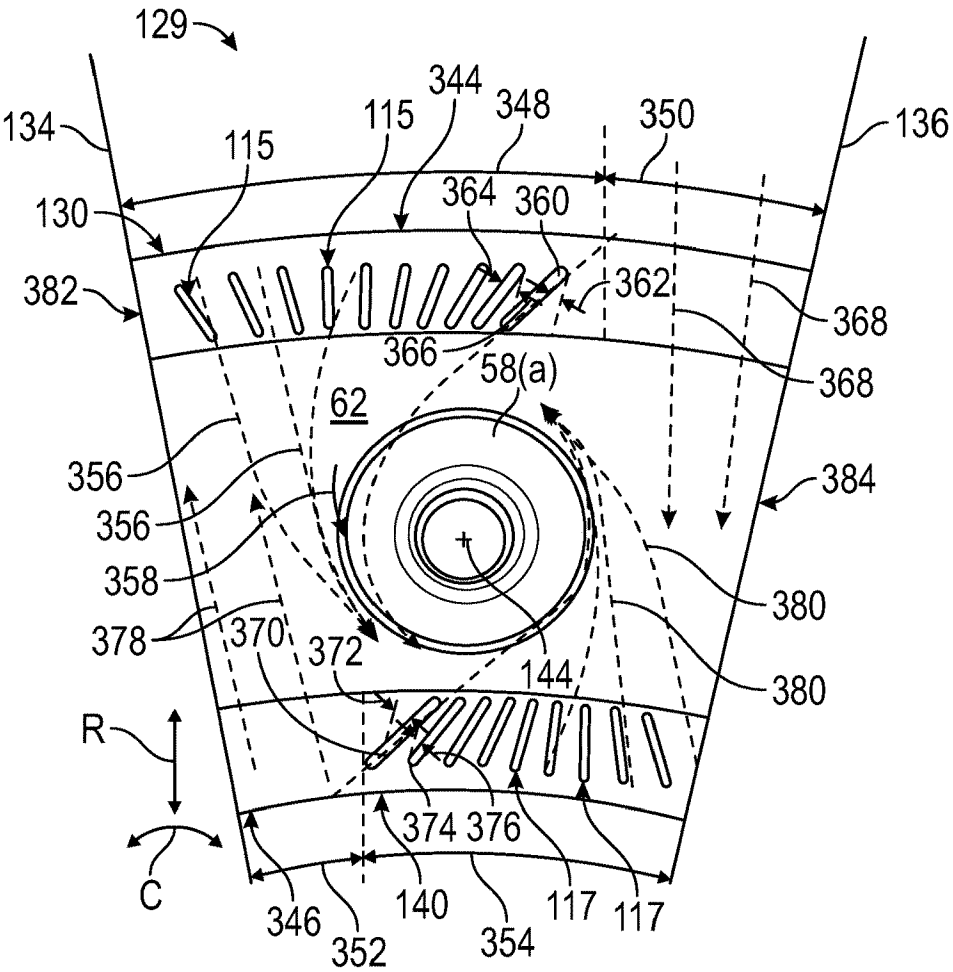
FIG. 22 depicts still yet another arrangement of the outer liner and inner liner slot dilution openings and swirl vanes taken at plane 22-22 of FIG. 4, according to still another aspect of the present disclosure.

FIG. 22 depicts still yet another arrangement of the outer liner and inner liner slot dilution openings and swirl vanes taken at plane 22-22 of FIG. 4, according to still another aspect of the present disclosure. As was briefly discussed above with regard to FIG. 3, the combustor liner 50 may be considered to be divided into a plurality of segments about the combustor centerline 112. FIG. 12 depicts the first segment 129 of FIG. 3, taken at the plane 22-22 through the annular outer slot dilution opening 114 and the annular inner liner slot dilution opening 116. As was briefly discussed above, each segment includes a corresponding segment swirler assembly 58, and in FIG. 12, the corresponding swirler assembly 58 of first segment 129 is swirler assembly 58(*a*). In addition, as was described above, each combustor liner segment defines a segment first end extending in the radial direction extending from the combustor centerline 112, and a segment second end extending in the radial direction from the combustor centerline 112 and circumferentially spaced apart from the segment first end. For first segment 129, a first end 382 can be seen to correspond to segment boundary line 134 and a second end 384 can be seen to correspond to segment boundary line 136. Further, as was previously described, each segment includes an outer liner segment portion (e.g., first segment outer liner 130) of the outer liner 54 and an inner liner segment portion (e.g., first segment inner liner 140) of the inner liner 52. The first segment outer liner 130 includes an outer liner segment portion radial wall 344 of the annular outer liner radial wall 146, and the first segment inner liner 140 includes an inner liner segment portion radial wall 346 of the annular inner liner radial wall 148. The outer liner segment portion radial wall 344 includes the plurality of outer liner swirl vanes 115 disposed in a first circumferential zone 348 of the outer liner segment portion radial wall 344, and does not include the plurality of outer liner swirl vanes 115 in a second circumferential zone 350 of the outer liner segment portion radial wall 344. On the other hand, the inner liner segment portion radial wall 346 does not include the plurality of inner liner swirl vanes 117 in a first circumferential zone 352 of the inner liner segment portion radial wall 346, and includes the plurality of inner liner swirl vanes 117 in a second circumferential zone 354 of the inner liner segment portion radial wall 346. The first circumferential zone 348 of the outer liner segment portion radial wall 344 is radially opposed across the combustion chamber 62 by the first circumferential zone 352 of the inner liner segment portion radial wall 346, and the second circumferential zone 350 of the outer liner segment portion radial wall 344 is radially opposed across the combustion chamber 62 by the second circumferential zone 354 of the inner liner segment portion radial wall 346. As shown in FIG. 22, however, the first circumferential zone 348 of the outer liner segment portion radial wall 344 may overlap circumferentially with the second circumferential zone 354 of the inner liner segment portion radial wall 346.

The plurality of outer liner swirl vanes 115 in the first circumferential zone 348 of the outer liner segment portion radial wall 344 are configured to provide an outer liner segment swirled flow of oxidizer 356 (i.e., compressed air 82(*d*)) into the combustion chamber 62 in a first circumferential swirl direction 358 about the segment swirler assembly centerline axis 144 of the first segment swirler assembly 58(*a*). In FIG. 21, the first circumferential swirl direction 358 is a counter-clockwise direction about the segment swirler assembly centerline axis 144, which extends in the axial direction. To provide the flow of the oxidizer in the first circumferential swirl direction, each outer liner swirl vane 115 among the plurality of outer liner swirl vanes provided in the first circumferential zone 348 of the outer liner segment portion radial wall 344 are arranged at different circumferential angles with respect to the segment swirler assembly centerline axis 144. For example, a first outer liner swirl vane 360 may be arranged at a first angle 362, and a second outer liner swirl vane 364 may be arranged at a second angle 366, where the first angle 362 is different from the second angle 366. In contrast, in the second circumferential zone 350 of the outer liner segment portion radial wall 344, where outer liner swirl vanes 115 are not included, a radial flow 368 of the oxidizer is provided into the combustion chamber 62.

Similarly, the plurality of inner liner swirl vanes 117 in the second circumferential zone 354 of the inner liner segment portion radial wall 346 are configured to provide an inner liner segment swirled flow of oxidizer 380 into the combustion chamber 62 in the first circumferential swirl direction 358 about the segment swirler assembly centerline axis 144 of the first segment swirler assembly 58(*a*). To provide the flow of the oxidizer in the first circumferential swirl direction 358, each inner liner swirl vane 117 among the plurality of outer liner swirl vanes provided in the second circumferential zone 354 of the inner liner segment portion radial wall 346 are arranged at different circumferential angles with respect to the segment swirler assembly centerline axis 144. For example, a first inner liner swirl vane 370 may be arranged at a first angle 372, and a second inner liner swirl vane 374 may be arranged at a second angle 376, where the first angle 372 is different from the second angle 376. In contrast, in the first circumferential zone 352 of the inner liner segment portion radial wall 346, where inner liner swirl vanes 117 are not included, a radial flow 378 of the oxidizer is provided into the combustion chamber 62.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A combustor liner for a combustor of a gas turbine, the combustor liner defining an axial direction, a radial direction, and a circumferential direction about a combustor centerline, the combustor liner comprising: an outer liner extending circumferentially about the combustor centerline, and extending in the axial direction from an outer liner upstream end to an outer liner downstream end, an outer liner dilution zone defined between the outer liner upstream end and the outer liner downstream end, the outer liner having an outer liner cold surface side and an outer liner hot surface side, and defining an outer liner flow direction extending in the axial direction from the outer liner upstream end to the outer liner downstream end, the outer liner including an annular outer liner slot dilution opening through the outer liner in the outer liner dilution zone, the annular outer liner slot dilution opening including a plurality of outer liner swirl vanes therewithin; and an inner liner extending circumferentially about the combustor centerline, and extending in the axial direction from an inner liner upstream end to an inner liner downstream end, an inner liner dilution zone defined between the inner liner upstream end and the inner liner downstream end, the inner liner having an inner liner cold surface side and an inner liner hot surface side, and defining an inner liner flow direction extending in the axial direction from the inner liner upstream end to the inner liner downstream end, the inner liner including an annular inner liner slot dilution opening through the inner liner in the inner liner dilution zone, the annular inner liner slot dilution opening including a plurality of inner liner swirl vanes therewithin, wherein a combustion chamber is defined between the outer liner hot surface side of the outer liner and the inner liner hot surface side of the inner liner.

The combustor liner according to any preceding clause, wherein the outer liner comprises (a) a first outer liner radial wall disposed at a downstream side of the annular outer liner slot dilution opening and extending radially outward from the outer liner cold surface side into an outer flow passage adjacent to the outer liner cold surface side, and (b) a second outer liner radial wall disposed at an upstream side of the annular outer liner slot dilution opening and extending radially outward from the outer liner cold surface side into the outer flow passage adjacent to the outer liner cold surface side, the plurality of outer liner swirl vanes being disposed between the first outer liner radial wall and the second outer liner radial wall, trailing edges of each of the plurality of outer liner swirl vanes being disposed adjacent to the outer liner cold surface side, and the inner liner comprises (a) a first inner liner radial wall disposed at a downstream side of the annular inner liner slot dilution opening and extending radially inward from the inner liner cold surface side into an inner flow passage adjacent to the inner liner cold surface side, and (b) a second inner liner radial wall disposed at an upstream side of the annular inner liner slot dilution opening and extending radially inward from the inner liner cold surface side into the inner flow passage adjacent to the inner liner cold surface side, the plurality of inner liner swirl vanes being disposed between the first inner liner radial wall and the second inner liner radial wall, trailing edges of each of the plurality of inner liner swirl vanes being disposed adjacent to the inner liner cold surface side.

The combustor liner according to any preceding clause, wherein the outer liner comprises (a) a first annular outer liner radial wall disposed on an upstream side of the annular outer liner slot dilution opening, (b) a second annular outer liner radial wall disposed on a downstream side of the annular outer liner slot dilution opening, the first annular outer liner radial wall and the second annular outer liner radial wall extending at a downstream angle, with respect to the combustor centerline and the radial direction, into an outer flow passage on the outer liner cold surface side of the outer liner, (c) a third annular outer liner radial wall disposed downstream of the second annular outer liner radial wall, (d) a fourth annular outer liner radial wall disposed downstream of the third annular outer liner radial wall, the third annular outer liner radial wall and the fourth annular outer liner radial wall extending at an upstream angle, with respect to the combustor centerline and the radial direction, into the outer flow passage on the outer liner cold surface side of the outer liner, (e) a second annular outer liner slot dilution opening defined between the third annular outer liner radial wall and the fourth annular outer liner radial wall, and (f) a second plurality of outer liner swirl vanes disposed within the second annular outer liner slot dilution opening, the annular outer liner slot dilution opening and the second annular outer liner slot dilution opening being arranged to provide a converging flow of an oxidizer at the outer liner hot surface side, and the inner liner comprises (a) a first annular inner liner radial wall disposed on an upstream side of the annular inner liner slot dilution opening, (b) a second annular inner liner radial wall disposed on a downstream side of the annular inner liner slot dilution opening, the first annular inner liner radial wall and the second annular inner liner radial wall extending at downstream angle, with respect to the combustor centerline and the radial direction, into an inner flow passage on the inner liner cold surface side of the inner liner, (c) a third annular inner liner radial wall disposed downstream of the second annular inner liner radial wall, (d) a fourth annular inner liner radial wall disposed downstream of the third annular inner liner radial wall, the third annular inner liner radial wall and the fourth annular inner liner radial wall extending at an upstream angle, with respect to the combustor centerline and the radial direction, into the inner flow passage on the inner liner cold surface side of the inner liner, (e) a second annular inner liner slot dilution opening defined between the third annular inner liner radial wall and the fourth annular inner liner radial wall, and (f) a second plurality of inner liner swirl vanes disposed within the second annular inner liner slot dilution opening, the annular inner liner slot dilution opening and the second annular inner liner slot dilution opening being arranged to provide a converging flow of the oxidizer at the inner liner hot surface side.

The combustor liner according to any preceding clause, wherein the plurality of outer liner swirl vanes are arranged to produce an outer liner swirled flow of oxidizer in the combustion chamber in a first direction with respect to the circumferential direction, and the plurality of inner liner swirl vanes are arranged to produce an inner liner swirled flow of oxidizer in the combustion chamber in a second direction with respect to the circumferential direction, the first direction and the second direction being in a same direction circumferentially about the combustor centerline.

The combustor liner according to any preceding clause, wherein the plurality of outer liner swirl vanes are arranged to produce an outer liner swirled flow of oxidizer in the combustion chamber in a first direction with respect to the circumferential direction, and the plurality of inner liner swirl vanes are arranged to produce an inner liner swirled flow of oxidizer in the combustion chamber in a second direction with respect to the circumferential direction, the first direction being in an opposite direction of the second direction circumferentially about the combustor centerline.

The combustor liner according to any preceding clause, wherein the outer liner comprises an annular outer liner radial wall disposed on an upstream side of the annular outer liner slot dilution opening and extending from the outer liner at least partially in the radial direction into the combustion chamber, and the inner liner comprises an annular inner liner radial wall disposed on an upstream side of the annular inner liner slot dilution opening and extending at least partially in the radial direction into the combustion chamber.

The combustor liner according to any preceding clause, wherein the combustor liner comprises a plurality of combustor liner segments arranged circumferentially about the combustor centerline, each combustor liner segment being associated with a corresponding segment swirler assembly among a plurality of swirler assemblies circumferentially spaced about the combustor centerline, and each combustor liner segment defining a segment first end extending in the radial direction extending from the combustor centerline, and a segment second end extending in the radial direction from the combustor centerline and circumferentially spaced apart from the segment first end, each segment including an outer liner segment portion of the outer liner and an inner liner segment portion of the inner liner, the outer liner segment portion including an outer liner segment portion radial wall of the annular outer liner radial wall, and the inner liner including an inner liner segment portion radial wall of the annular inner liner radial wall, wherein the outer liner segment portion radial wall includes the plurality of outer liner swirl vanes disposed in a first circumferential zone of the outer liner segment portion radial wall and does not include the plurality of outer liner swirl vanes in second circumferential zone of the outer liner segment portion radial wall, and the inner liner segment portion radial wall does not include the plurality of inner liner swirl vanes in a first circumferential zone of the inner liner segment portion radial wall and includes the plurality of inner liner swirl vanes on a second circumferential zone of the inner liner segment portion radial wall, the first circumferential zone of the outer liner segment portion radial wall being radially opposed across the combustion chamber by the first circumferential zone of the inner liner segment portion radial wall, and the second circumferential zone of the outer liner segment portion radial wall being radially opposed across the combustion chamber by the second circumferential zone of the inner liner segment portion radial wall.

The combustor liner according to any preceding clause, wherein the plurality of outer liner swirl vanes in the first circumferential zone of the outer liner segment portion radial wall are configured to provide an outer liner segment swirled flow of oxidizer into the combustion chamber in a first circumferential swirl direction about a swirler centerline axis of the segment swirler, the swirler centerline axis extending in the axial direction, and the plurality of inner liner swirl vanes in the second circumferential zone of the inner liner segment portion radial wall are configured to provide an inner liner segment swirled flow of oxidizer into the combustion chamber in the first circumferential swirl direction.

The combustor liner according to any preceding clause, wherein an outer liner radial flow of oxidizer is provided in the radial direction through the second circumferential zone of the outer liner segment portion radial wall, and an inner liner radial flow of oxidizer is provided in the radial direction through the first circumferential zone of the inner liner segment portion radial wall.

The combustor liner according to any preceding clause, wherein each outer liner swirl vane among the plurality of outer liner swirl vanes provided in the first circumferential zone of the outer liner segment portion radial wall is arranged at different circumferential angles with respect to the segment swirler centerline axis, and each inner liner swirl vane among the plurality of inner liner swirl vanes provided in the second circumferential zone of the inner liner segment portion radial wall is arranged at different circumferential angles with respect to the segment swirler centerline axis.

The combustor liner according to any preceding clause, wherein the outer liner further comprises a second annular outer liner slot dilution opening disposed at an upstream side of the annular outer liner radial wall, and the inner liner further comprises a second annular inner liner slot dilution opening disposed at an upstream side of the annular inner liner radial wall.

The combustor liner according to any preceding clause, wherein the second annular outer liner slot dilution opening includes a second plurality of outer liner swirl vanes, a tapered radially inner portion of the plurality of outer liner swirl vanes extends from a downstream side of the annular outer liner slot dilution opening at the outer liner hot surface side to a radially inner end of the annular outer liner radial wall, and a tapered radially inner portion of the second plurality of outer liner swirl vanes extends from an upstream side of the outer liner second annular slot dilution opening at the outer liner hot surface side to the radially inner end of the annular outer liner radial wall, and the second annular inner liner slot dilution opening includes a second plurality of inner liner swirl vanes, wherein a tapered radially outer portion of the plurality of inner liner swirl vanes extends from a downstream side of the annular inner liner slot dilution opening at the inner liner hot surface side to a radially outer end of the annular inner liner radial wall, and a tapered radially outer portion of the second plurality of inner liner swirl vanes extends from an upstream side of the inner liner second annular slot dilution opening at the inner liner hot surface side to the radially outer end of the annular inner liner radial wall.

The combustor liner according to any preceding clause, wherein the annular outer liner radial wall further extends into an outer flow passage on the outer liner cold surface side, and the outer liner further comprises (a) a second annular outer liner radial wall disposed at a downstream side of the annular outer liner slot dilution opening and extending radially outward from the outer liner cold surface side into the outer flow passage, the plurality of outer liner swirl vanes being disposed between the annular outer liner radial wall and the second annular outer liner radial wall, (b) a third outer liner radial wall disposed at an upstream side of the second annular outer liner slot dilution opening and extending radially outward from the outer liner cold surface side into the outer flow passage, and (c) a second plurality of outer liner swirl vanes disposed in the second annular outer liner slot dilution opening between the annular outer liner radial wall and the third annular outer liner radial wall, trailing edges of each of the plurality of outer liner swirl vanes being disposed adjacent to the outer liner cold surface side, and trailing edges of each of the second plurality of outer liner swirl vanes being disposed adjacent to the outer liner cold surface side, and the annular inner liner radial wall further extends into an inner flow passage on the inner liner cold surface side, and the inner liner further comprises (a) a second annular inner liner radial wall disposed at a downstream side of the annular inner liner slot dilution opening and extending radially inward from the inner liner cold surface side into the inner flow passage, the plurality of inner liner swirl vanes being disposed between the annular inner liner radial wall and the second annular inner liner radial wall, (b) a third annular inner liner radial wall disposed at an upstream side of the second annular inner liner slot dilution opening and extending radially inward from the inner liner cold surface side into the inner flow passage, and (c) a second plurality of inner liner swirl vanes disposed in the second annular inner liner slot dilution opening between the annular inner liner radial wall and the third annular inner liner radial wall, trailing edges of each of the plurality of inner liner swirl vanes being disposed adjacent to the inner liner cold surface side, and trailing edges of each of the second plurality of inner liner swirl vanes being disposed adjacent to the inner liner cold surface side.

The combustor liner according to any preceding clause, wherein trailing edges of each of the plurality of outer liner swirl vanes extend from a radially inner end of the annular outer liner radial wall to a downstream side of the annular outer liner slot dilution opening at the outer liner hot surface side of the outer liner, and wherein trailing edges of each of the plurality of inner liner swirl vanes extend from a radially outer end of the annular inner liner radial wall to a downstream side of the annular inner liner slot dilution opening at the inner liner hot surface side of the inner liner.

The combustor liner according to any preceding clause, wherein the outer liner further comprises a second annular outer liner radial wall disposed on a downstream side of the annular outer liner slot dilution opening, the plurality of outer liner swirl vanes being arranged between the annular outer liner radial wall and the second annular outer liner radial wall, and the inner liner further comprises a second annular inner liner radial wall disposed on a downstream side of the annular inner liner slot dilution opening, the plurality of inner liner swirl vanes being arranged between the annular inner liner radial wall and the second annular inner liner radial wall.

The combustor liner according to any preceding clause, wherein the outer liner further comprises (a) a third annular outer liner radial wall disposed at an upstream side of the second annular outer liner slot dilution opening and extending at least partially into an outer flow passage on the outer liner cold surface side, and (b) a second plurality of outer liner swirl vanes disposed in the second annular outer liner slot dilution opening between a downstream side of the third annular outer liner radial wall and an upstream side of the annular outer liner radial wall, the annular outer liner radial wall further extending at least partially into the outer flow passage, and the annular outer liner radial wall, the second annular outer liner radial wall, and the third annular outer liner radial wall being arranged at an upstream angle, and the inner liner further comprises (a) a third annular inner liner radial wall disposed at an upstream side of the second annular inner liner slot dilution opening and extending at least partially into an inner flow passage on the inner liner cold surface side, and (b) a second plurality of inner liner swirl vanes disposed in the second annular inner liner slot dilution opening between a downstream side of the third annular inner liner radial wall and an upstream side of the annular inner liner radial wall, the annular inner liner radial wall further extending at least partially into the inner flow passage, and the annular inner liner radial wall, the second annular inner liner radial wall, and the third annular inner liner radial wall being arranged at an upstream angle.

The combustor liner according to any preceding clause, wherein the annular outer liner radial wall and the second annular outer liner radial wall extend at a downstream angle, with respect to the radial direction, into the combustion chamber, and the annular inner liner radial wall and the second annular inner liner radial wall extend at a downstream angle, with respect to the radial direction, into the combustion chamber.

The combustor liner according to any preceding clause, wherein the outer liner further comprises (a) a third annular outer liner slot dilution opening at a downstream side of the second annular outer liner radial wall, (b) a third annular outer liner radial wall disposed at a downstream side of the third annular outer liner slot dilution opening and extending at a downstream angle, with respect to the axial direction, into the combustion chamber, and (c) a second plurality of outer liner swirl vanes disposed in the third annular outer liner slot dilution opening arranged between the downstream side of the second annular outer liner radial wall and an upstream side of the third annular outer liner radial wall, and the inner liner further comprises (a) a third annular inner liner slot dilution opening at a downstream side of the second annular inner liner radial wall, (b) a third inner liner radial wall disposed at a downstream side of the third annular inner liner slot dilution opening and extending at a downstream angle, with respect to the axial direction, into the combustion chamber, and (c) a second plurality of inner liner swirl vanes disposed in the third annular inner liner slot dilution opening arranged between the downstream side of the second annular inner liner radial wall and an upstream side of the third inner liner radial wall.

The combustor liner according to any preceding clause, wherein the annular outer liner radial wall and the second annular outer liner radial wall extend radially into the combustion chamber perpendicular to the axial direction, and the annular inner liner radial wall and the second annular inner liner radial wall extend radially into the combustion chamber perpendicular to the axial direction.

The combustor liner according to any preceding clause, wherein the second annular outer liner slot dilution opening includes a second plurality of outer liner swirl vanes disposed on an upstream side of the annular outer liner radial wall, and the second annular inner liner slot dilution opening includes a second plurality of inner liner swirl vanes disposed on an upstream side of the annular inner liner radial wall.

The combustor liner according to any preceding clause, wherein the outer liner further comprises (a) a third annular outer liner slot dilution opening at a downstream side of the second annular outer liner radial wall, (b) a third annular outer liner radial wall disposed at a downstream side of the third annular outer liner slot dilution opening and extending radially into the combustion chamber perpendicular to the axial direction, and (c) a second plurality of outer liner swirl vanes disposed in the third annular outer liner slot dilution opening arranged between the downstream side of the second annular outer liner radial wall and an upstream side of the third annular outer liner radial wall, and the inner liner further comprises (a) a third annular inner liner slot dilution opening at a downstream side of the second annular inner liner radial wall, (b) a third annular inner liner radial wall disposed at a downstream side of the third annular inner liner slot dilution opening and extending radially into the combustion chamber perpendicular to the axial direction, and (c) a second plurality of inner liner swirl vanes disposed in the third annular inner liner slot dilution opening arranged between the downstream side of the second annular inner liner radial wall and an upstream side of the third annular inner liner radial wall.

The combustor liner according to any preceding clause, wherein the annular outer liner radial wall further extends into an outer flow passage on the outer liner cold surface side, and the outer liner further comprises (a) a third annular outer liner radial wall extending radially outward from the outer liner cold surface side at an upstream end of the second annular outer liner slot dilution opening into the outer flow passage, and (b) a second plurality of outer liner swirl vanes disposed in the second annular outer liner slot dilution opening between the annular outer liner radial wall and the third annular outer liner radial wall, trailing edges of each of the plurality of outer liner swirl vanes being disposed adjacent to a radially inner end of the annular outer liner radial wall, and trailing edges of each of the second plurality of outer liner swirl vanes is disposed adjacent to the outer liner cold surface side, and the annular inner liner radial wall further extends into an inner flow passage on the inner liner cold surface side, and the inner liner further comprises (a) a third annular inner liner radial wall extending radially inward from the inner liner cold surface side at an upstream end of the second annular inner liner slot dilution opening into the inner flow passage, and (b) a second plurality of inner liner swirl vanes disposed in the second annular inner liner slot dilution opening between the annular inner liner radial wall and the third annular inner liner radial wall, trailing edges of each of the plurality of inner liner swirl vanes being disposed adjacent to a radially outer end of the annular inner liner radial wall, and trailing edges of each of the second plurality of inner liner swirl vanes being disposed adjacent to the inner liner cold surface side.

The combustor liner according to any preceding clause, wherein each of the plurality of outer liner swirl vanes extend, in the axial direction, between an upstream side of the annular outer liner slot dilution opening to a downstream side of the annular slot dilution opening, and extending lengthwise in the radial direction, a downstream lengthwise portion of each of the plurality of outer liner swirl vanes at the downstream side of the annular outer liner slot dilution opening extending in the radial direction, a middle lengthwise portion of each of the plurality of outer liner swirl vanes, at an axial mid-point of the outer line swirl vane, including a first curved outlet end arranged at a first angle with respect to the radial direction, and an upstream lengthwise portion of each of the plurality of outer liner swirl vanes, at the upstream side of the annular outer liner slot dilution opening, including a second curved outlet end arranged at a second angle greater than the first angle.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor liner for a combustor of a gas turbine engine, the combustor including a combustion chamber, the combustor liner defining an axial direction, a radial direction, and a circumferential direction about a combustor centerline, the combustor liner comprising:

an outer liner extending circumferentially about the combustor centerline, and extending in the axial direction from an outer liner upstream end to an outer liner downstream end, an outer liner dilution zone defined between the outer liner upstream end and the outer liner downstream end, the outer liner having an outer liner cold surface side and an outer liner hot surface side, and defining an outer liner flow direction extending in the axial direction from the outer liner upstream end to the outer liner downstream end, the outer liner including an annular outer liner radial wall located at the outer liner dilution zone, the annular outer liner radial wall extending from the outer liner at least partially in the radial direction into the combustion chamber, the annular outer liner radial wall and the outer liner defining an annular outer liner slot dilution opening therebetween, the annular outer liner slot dilution opening extending through the outer liner, the annular outer liner radial wall and the annular outer liner slot dilution opening extending continuously in the circumferential direction about the combustor centerline, the annular outer liner slot dilution opening including a plurality of outer liner swirl vanes therewithin; and an inner liner extending circumferentially about the combustor centerline, and extending in the axial direction from an inner liner upstream end to an inner liner downstream end, an inner liner dilution zone defined between the inner liner upstream end and the inner liner downstream end, the inner liner having an inner liner cold surface side and an inner liner hot surface side, and defining an inner liner flow direction extending in the axial direction from the inner liner upstream end to the inner liner downstream end, the inner liner including an annular inner liner radial wall located at the inner liner dilution zone, the annular inner liner radial wall extending from the inner liner at least partially in the radial direction into the combustion chamber, the annular inner liner radial wall and the inner liner defining an annular inner liner slot dilution opening therebetween, the annular inner liner slot dilution opening extending through the inner liner, the annular inner liner radial wall and the annular inner liner slot dilution opening extending continuously in the circumferential direction about the combustor centerline, the annular inner liner slot dilution opening including a plurality of inner liner swirl vanes therewithin, wherein the combustion chamber is defined between the outer liner hot surface side of the outer liner and the inner liner hot surface side of the inner liner.

2. The combustor liner according to claim 1, wherein the outer liner comprises (a) the annular outer liner radial wall disposed at a downstream side of the annular outer liner slot dilution opening and extending radially outward from the outer liner cold surface side into an outer flow passage adjacent to the outer liner cold surface side, and (b) a second outer liner radial wall disposed at an upstream side of the annular outer liner slot dilution opening and extending radially outward from the outer liner cold surface side into the outer flow passage adjacent to the outer liner cold surface side, the plurality of outer liner swirl vanes being disposed between the annular outer liner radial wall and the second outer liner radial wall, trailing edges of each of the plurality of outer liner swirl vanes being disposed adjacent to the outer liner cold surface side, and the inner liner comprises (a) the annular inner liner radial wall disposed at a downstream side of the annular inner liner slot dilution opening and extending radially inward from the inner liner cold surface side into an inner flow passage adjacent to the inner liner cold surface side, and (b) a second inner liner radial wall disposed at an upstream side of the annular inner liner slot dilution opening and extending radially inward from the inner liner cold surface side into the inner flow passage adjacent to the inner liner cold surface side, the plurality of inner liner swirl vanes being disposed between the annular inner liner radial wall and the second inner liner radial wall, trailing edges of each of the plurality of inner liner swirl vanes being disposed adjacent to the inner liner cold surface side.

3. The combustor liner according to claim 1, wherein each of the plurality of outer liner swirl vanes extend, in the axial direction, between an upstream side of the annular outer liner slot dilution opening to a downstream side of the annular outer liner slot dilution opening, and extend lengthwise in the radial direction, a downstream lengthwise portion of each of the plurality of outer liner swirl vanes at the downstream side of the annular outer liner slot dilution opening extending in the radial direction, a middle lengthwise portion of each of the plurality of outer liner swirl vanes, at an axial mid-point of each of the plurality of outer liner swirl vanes, including a first curved outlet end arranged at a first angle with respect to the radial direction, and an upstream lengthwise portion of each of the plurality of outer liner swirl vanes, at the upstream side of the annular outer liner slot dilution opening, including a second curved outlet end arranged at a second angle greater than the first angle.

4. The combustor liner according to claim 1, wherein the annular outer liner radial wall is disposed on an upstream side of the annular outer liner slot dilution opening, and the annular inner liner radial wall is disposed on an upstream side of the annular inner liner slot dilution opening.

5. The combustor liner according to claim 4, wherein the combustor liner comprises a plurality of combustor liner segments arranged circumferentially about the combustor centerline, each combustor liner segment being associated with a corresponding segment swirler assembly among a plurality of swirler assemblies circumferentially spaced about the combustor centerline, and each combustor liner segment defining a segment first end extending in the radial direction extending from the combustor centerline, and a segment second end extending in the radial direction from the combustor centerline and circumferentially spaced apart from the segment first end, each segment including an outer liner segment portion of the outer liner and an inner liner segment portion of the inner liner, the outer liner segment portion including an outer liner segment portion radial wall of the annular outer liner radial wall, and the inner liner including an inner liner segment portion radial wall of the annular inner liner radial wall, wherein the outer liner segment portion radial wall includes the plurality of outer liner swirl vanes disposed in a first circumferential zone of the outer liner segment portion radial wall and does not include the plurality of outer liner swirl vanes in second circumferential zone of the outer liner segment portion radial wall, and the inner liner segment portion radial wall does not include the plurality of inner liner swirl vanes in a first circumferential zone of the inner liner segment portion radial wall and includes the plurality of inner liner swirl vanes on a second circumferential zone of the inner liner segment portion radial wall, the first circumferential zone of the outer liner segment portion radial wall being radially opposed across the combustion chamber by the first circumferential zone of the inner liner segment portion radial wall, and the second circumferential zone of the outer liner segment portion radial wall being radially opposed across the combustion chamber by the second circumferential zone of the inner liner segment portion radial wall.

6. The combustor liner according to claim 5, wherein the plurality of outer liner swirl vanes in the first circumferential zone of the outer liner segment portion radial wall are configured to provide an outer liner segment swirled flow of oxidizer into the combustion chamber in a first circumferential swirl direction about a segment swirler centerline axis of a corresponding segment swirler, the segment swirler centerline axis extending in the axial direction, and the plurality of inner liner swirl vanes in the second circumferential zone of the inner liner segment portion radial wall are configured to provide an inner liner segment swirled flow of oxidizer into the combustion chamber in the first circumferential swirl direction.

7. The combustor liner according to claim 6, wherein an outer liner radial flow of oxidizer is provided in the radial direction through the second circumferential zone of the outer liner segment portion radial wall, and an inner liner radial flow of oxidizer is provided in the radial direction through the first circumferential zone of the inner liner segment portion radial wall.

8. The combustor liner according to claim 6, wherein each outer liner swirl vane among the plurality of outer liner swirl vanes provided in the first circumferential zone of the outer liner segment portion radial wall is arranged at different circumferential angles with respect to the segment swirler centerline axis, and each inner liner swirl vane among the plurality of inner liner swirl vanes provided in the second circumferential zone of the inner liner segment portion radial wall is arranged at different circumferential angles with respect to the segment swirler centerline axis.

9. The combustor liner according to claim 4, wherein the outer liner further comprises a second annular outer liner slot dilution opening disposed at an upstream side of the annular outer liner radial wall, and the inner liner further comprises a second annular inner liner slot dilution opening disposed at an upstream side of the annular inner liner radial wall.

10. The combustor liner according to claim 9, wherein the second annular outer liner slot dilution opening includes a second plurality of outer liner swirl vanes, a tapered radially inner portion of the plurality of outer liner swirl vanes extends from a downstream side of the annular outer liner slot dilution opening at the outer liner hot surface side to a radially inner end of the annular outer liner radial wall, and a tapered radially inner portion of the second plurality of outer liner swirl vanes extends from an upstream side of the outer liner second annular slot dilution opening at the outer liner hot surface side to the radially inner end of the annular outer liner radial wall, and the second annular inner liner slot dilution opening includes a second plurality of inner liner swirl vanes, wherein a tapered radially outer portion of the plurality of inner liner swirl vanes extends from a downstream side of the annular inner liner slot dilution opening at the inner liner hot surface side to a radially outer end of the annular inner liner radial wall, and a tapered radially outer portion of the second plurality of inner liner swirl vanes extends from an upstream side of the inner liner second annular slot dilution opening at the inner liner hot surface side to the radially outer end of the annular inner liner radial wall.

11. The combustor liner according to claim 9, wherein the annular outer liner radial wall further extends into an outer flow passage on the outer liner cold surface side, and the outer liner further comprises (a) a second annular outer liner radial wall disposed at a downstream side of the annular outer liner slot dilution opening and extending radially outward from the outer liner cold surface side into the outer flow passage, the plurality of outer liner swirl vanes being disposed between the annular outer liner radial wall and the second annular outer liner radial wall, (b) a third annular outer liner radial wall disposed at an upstream side of the second annular outer liner slot dilution opening and extending radially outward from the outer liner cold surface side into the outer flow passage, and (c) a second plurality of outer liner swirl vanes disposed in the second annular outer liner slot dilution opening between the annular outer liner radial wall and the third annular outer liner radial wall, trailing edges of each of the plurality of outer liner swirl vanes being disposed adjacent to the outer liner cold surface side, and trailing edges of each of the second plurality of outer liner swirl vanes being disposed adjacent to the outer liner cold surface side, and the annular inner liner radial wall further extends into an inner flow passage on the inner liner cold surface side, and the inner liner further comprises (a) a second annular inner liner radial wall disposed at a downstream side of the annular inner liner slot dilution opening and extending radially inward from the inner liner cold surface side into the inner flow passage, the plurality of inner liner swirl vanes being disposed between the annular inner liner radial wall and the second annular inner liner radial wall, (b) a third annular inner liner radial wall disposed at an upstream side of the second annular inner liner slot dilution opening and extending radially inward from the inner liner cold surface side into the inner flow passage, and (c) a second plurality of inner liner swirl vanes disposed in the second annular inner liner slot dilution opening between the annular inner liner radial wall and the third annular inner liner radial wall, trailing edges of each of the plurality of inner liner swirl vanes being disposed adjacent to the inner liner cold surface side, and trailing edges of each of the second plurality of inner liner swirl vanes being disposed adjacent to the inner liner cold surface side.

12. The combustor liner according to claim 9, wherein trailing edges of each of the plurality of outer liner swirl vanes extend from a radially inner end of the annular outer liner radial wall to a downstream side of the annular outer liner slot dilution opening at the outer liner hot surface side of the outer liner, and wherein trailing edges of each of the plurality of inner liner swirl vanes extend from a radially outer end of the annular inner liner radial wall to a downstream side of the annular inner liner slot dilution opening at the inner liner hot surface side of the inner liner.

13. The combustor liner according to claim 9, wherein the outer liner further comprises a second annular outer liner radial wall disposed on a downstream side of the annular outer liner slot dilution opening, the plurality of outer liner swirl vanes being arranged between the annular outer liner radial wall and the second annular outer liner radial wall, and the inner liner further comprises a second annular inner liner radial wall disposed on a downstream side of the annular inner liner slot dilution opening, the plurality of inner liner swirl vanes being arranged between the annular inner liner radial wall and the second annular inner liner radial wall.

14. The combustor liner according to claim 13, wherein the outer liner further comprises (a) a third annular outer liner radial wall disposed at an upstream side of the second annular outer liner slot dilution opening and extending at least partially into an outer flow passage on the outer liner cold surface side, and (b) a second plurality of outer liner swirl vanes disposed in the second annular outer liner slot dilution opening between the third annular outer liner radial wall and the annular outer liner radial wall, the annular outer liner radial wall further extending at least partially into the outer flow passage, and the inner liner further comprises (a) a third annular inner liner radial wall disposed at an upstream side of the second annular inner liner slot dilution opening and extending at least partially into an inner flow passage on the inner liner cold surface side, and (b) a second plurality of inner liner swirl vanes disposed in the second annular inner liner slot dilution opening between the third annular inner liner radial wall and the annular inner liner radial wall, the annular inner liner radial wall further extending at least partially into the inner flow passage.

15. The combustor liner according to claim 13, wherein the annular outer liner radial wall and the second annular outer liner radial wall extend at a downstream angle, with respect to the radial direction, into the combustion chamber, and the annular inner liner radial wall and the second annular inner liner radial wall extend at a downstream angle, with respect to the radial direction, into the combustion chamber.

16. The combustor liner according to claim 15, wherein the outer liner further comprises (a) a third annular outer liner slot dilution opening at a downstream side of the second annular outer liner radial wall, (b) a third annular outer liner radial wall disposed downstream of the third annular outer liner slot dilution opening and extending at a downstream angle, with respect to the radial direction, into the combustion chamber, and (c) a second plurality of outer liner swirl vanes disposed in the third annular outer liner slot dilution opening arranged between the second annular outer liner radial wall and the third annular outer liner radial wall, and the inner liner further comprises (a) a third annular inner liner slot dilution opening at a downstream side of the second annular inner liner radial wall, (b) a third annular inner liner radial wall disposed downstream of the third annular inner liner slot dilution opening and extending at a downstream angle, with respect to the radial direction, into the combustion chamber, and (c) a second plurality of inner liner swirl vanes disposed in the third annular inner liner slot dilution opening arranged between the second annular inner liner radial wall and the third annular inner liner radial wall.

17. The combustor liner according to claim 13, wherein the annular outer liner radial wall and the second annular outer liner radial wall extend radially into the combustion chamber perpendicular to the axial direction, and the annular inner liner radial wall and the second annular inner liner radial wall extend radially into the combustion chamber perpendicular to the axial direction.

18. The combustor liner according to claim 17, wherein the second annular outer liner slot dilution opening includes a second plurality of outer liner swirl vanes disposed on an upstream side of the annular outer liner radial wall, and the second annular inner liner slot dilution opening includes a second plurality of inner liner swirl vanes disposed on an upstream side of the annular inner liner radial wall.

19. The combustor liner according to claim 17, wherein the outer liner further comprises (a) a third annular outer liner slot dilution opening at a downstream side of the second annular outer liner radial wall, (b) a third annular outer liner radial wall disposed downstream of the third annular outer liner slot dilution opening and extending radially into the combustion chamber perpendicular to the axial direction, and (c) a second plurality of outer liner swirl vanes disposed in the third annular outer liner slot dilution opening arranged between the second annular outer liner radial wall and the third annular outer liner radial wall, and the inner liner further comprises (a) a third annular inner liner slot dilution opening at a downstream side of the second annular inner liner radial wall, (b) a third annular inner liner radial wall disposed downstream of the third annular inner liner slot dilution opening and extending radially into the combustion chamber perpendicular to the axial direction, and (c) a second plurality of inner liner swirl vanes disposed in the third annular inner liner slot dilution opening arranged between the second annular inner liner radial wall and the third annular inner liner radial wall.

20. The combustor liner according to claim 17, wherein the annular outer liner radial wall further extends into an outer flow passage on the outer liner cold surface side, and the outer liner further comprises (a) a third annular outer liner radial wall extending radially outward from the outer liner cold surface side at an upstream side of the second annular outer liner slot dilution opening into the outer flow passage, and (b) a second plurality of outer liner swirl vanes disposed in the second annular outer liner slot dilution opening between the annular outer liner radial wall and the third annular outer liner radial wall, trailing edges of each of the plurality of outer liner swirl vanes being disposed adjacent to a radially inner end of the annular outer liner radial wall, and trailing edges of each of the second plurality of outer liner swirl vanes being disposed adjacent to the outer liner cold surface side, and the annular inner liner radial wall further extends into an inner flow passage on the inner liner cold surface side, and the inner liner further comprises (a) a third annular inner liner radial wall extending radially inward from the inner liner cold surface side at an upstream side of the second annular inner liner slot dilution opening into the inner flow passage, and (b) a second plurality of inner liner swirl vanes disposed in the second annular inner liner slot dilution opening between the annular inner liner radial wall and the third annular inner liner radial wall, trailing edges of each of the plurality of inner liner swirl vanes being disposed adjacent to a radially outer end of the annular inner liner radial wall, and trailing edges of each of the second plurality of inner liner swirl vanes being disposed adjacent to the inner liner cold surface side.

* * * * *